US005590863A

United States Patent [19]

Sasaki

[11] Patent Number: 5,590,863

[45] Date of Patent: Jan. 7, 1997

[54] SUPPORT

[76] Inventor: Mitsuo Sasaki, 3-11-12 Yamato-higashi, Yamato-shi, Kanagawa-ken, Japan

[21] Appl. No.: 332,125

[22] Filed: Oct. 31, 1994

[30] Foreign Application Priority Data

Nov. 12, 1993 [JP] Japan ..... 5-306136
Aug. 1, 1994 [JP] Japan ..... 6-197148

[51] Int. Cl.[6] ..... E04G 25/06

[52] U.S. Cl. ..... 248/354.3; 248/354.5; 248/357

[58] Field of Search ..... 248/354.1, 354.3, 248/354.5, 354.6, 357, 405, 407, 188.5

[56] References Cited

U.S. PATENT DOCUMENTS

| | | | |
|---|---|---|---|
| 2,540,752 | 2/1951 | Negovan | 248/354.3 |
| 3,927,863 | 12/1975 | Polsky | 248/354.3 X |
| 4,752,057 | 6/1988 | Hagemes | 248/354.3 X |

FOREIGN PATENT DOCUMENTS

| | | | |
|---|---|---|---|
| 697894 | 1/1931 | France | 248/354.5 |
| 855157 | 11/1952 | Germany | 248/354.5 |
| 865292 | 2/1953 | Germany | 248/354.3 |
| 2206351 | 4/1980 | Germany | 248/354.3 |
| 510475 | 1/1957 | Italy | 248/354.3 |
| 883701 | 12/1961 | United Kingdom | 248/354.3 |
| 1187586 | 4/1970 | United Kingdom | 248/354.3 |

*Primary Examiner*—Derek J. Berger
*Attorney, Agent, or Firm*—Beveridge, DeGrandi, Weilacher & Young, L.L.P.

[57] ABSTRACT

A support including a support pipe having a pair of elongated holes formed therein, a support ring, an insertion pipe having plural pairs of pin holes formed therein, and a support pin. The support ring includes a main support ring member having an internal thread formed in the inner peripheral portion thereof and an upper support ring member rotatably coupled to the upper end portion of the main support ring member via an upper thrust bearing. A rotary operation handle is fitted to the outer peripheral portion of the main support ring member.

11 Claims, 28 Drawing Sheets

20
22
33
28
32
30
6
38
34
44
27
31
36
26
40
42
54
52
24
48
10
50
19
14

SUPPORT

FIELD OF THE INVENTION

The present invention relates to a support of which the length can be freely adjusted in the axial direction and which can be used for constructing the slab form of concrete buildings as well as for oblique support for buildings, landslide-preventing support for civil engineering, and for supporting trees and fruit trees.

DESCRIPTION OF THE PRIOR ART

In forming slabs of a concrete building, for instance, a plurality of supports are usually used for supporting the slab form. That is, in forming the slabs, a plurality of supports are, first, arranged at predetermined positions via steady-rest pipes. After the heights at the upper ends of the supports have been adjusted, a square pipe which is a sleeper is provided at the upper ends. A round pipe which is a common joist is assembled on the round pipe at right angles thereto, and a veneer is placed on the round pipe thereby to assemble a slab form at the upper ends of the supports. Then, concrete is poured into the form to form the slab. The supports are used for holding the form at a proper level and for supporting the weight of the concrete that is poured, and play a very important role for forming the slabs.

A typical example of the conventional support will be described with reference to FIGS. 32 and 33. A support 400 is provided with a support pipe 404 having a base 402 at the lower end thereof, a support ring 406, an insertion pipe 410 having a receiving plate 408 at the upper end thereof, and a support pin 412. An external thread 414 is formed at the upper portion of the support pipe 404. A pair of elongated holes 416 are formed in the externally threaded portion of the support pipe 404 where the external thread 414 is formed, the pair of elongated holes 416 penetrating from the outer peripheral surface on one side thereof to the outer peripheral surface on the other side thereof and extending in the axial direction. FIG. 32 shows only one of the pair of elongated holes 416. An internal thread (not shown) is formed in the inner peripheral portion of the support ring 406, and a rotary operation handle 418 is fitted to the outer peripheral portion of the support ring 406. The rotary operation handle 418 is rotatably supported so as to move between a horizontal position (indicated by a solid line in FIG. 32) and a vertical position (indicated by a two-dot chain line in FIG. 32). The support ring 406 has its internal thread engaged with the external thread 414 of the support pipe 404 so as to move in the axial direction. The support pipe 412 is detachably coupled by a chain 420 to the outer peripheral portion of the support ring 406. That is, one end of the chain 420 is coupled to the head of the support pin 412, and the other end thereof is hooked to a screw 407 provided at the outer peripheral portion of the support ring 406.

The insertion pipe 410 is inserted in the support pipe 404 so as to be allowed to move in the axial direction thereof, and has plural pairs of pin holes 422 formed, at intervals in the axial direction, penetrating from the outer peripheral surface on one side thereof to the outer peripheral surface on the other side thereof. FIG. 32 shows only one side of the pairs of pin holes 422. The pair of elongated holes 416 have a width which is larger than the diameter of the pairs of pin holes 422. The support pin 412 has such a diameter that can be freely inserted in, and pulled out from, the pair of elongated holes 416 and pairs of pin holes 422. In a state where the insertion pipe 410 is inserted in the support pipe 404, the support pin 412 is inserted in one of the pairs of pin holes 422 of the insertion pipe 410 through the pair of elongated holes 416. In this case, the support pin 412 has such a length that both ends thereof outwardly protrude in the radial direction of the support pipe 404 from the pair of elongated holes 416. In the same state, furthermore, both ends of the support pin 412 are placed on the upper end surface of the support ring 406 and the insertion pipe 410 is supported by the support pipe 404 in a manner that its height can be freely adjusted.

The support 400 is used, for example, as described below as a means for supporting the slab form of a concrete building. Though the supports 400 are used in a plural number, only one support 400 will be described here for easy explanation. The support pipe 404 is placed on a mounting surface such as a floor that is not shown, via a base 402. A support ring 406 has been in advance engaged with the external thread 414 of the support pipe 404. The insertion pipe 410 is inserted from the upper end of the support pipe 404. The receiving plate 408 of the insertion pipe 410 is roughly set to a predetermined height from the floor, and the position in the circumferential direction of a pair of pin holes 422 is brought into match with the pair of elongated holes 416 of the support pipe 404 (to accomplish the positioning). Then, the support pin 412 is inserted in the pair of elongated holes 416 and in the pair of pin holes 422, and both ends thereof are so positioned as to outwardly protrude in the radial direction of the support pipe 404 from the pair of elongated holes 416. When the insertion pipe 410 is lowered in this state, both ends of the support pin 412 are placed on the upper end surface of the support ring 406. Then, the insertion pipe 410 is stably supported by the support pipe 404 via the support pin 412 and the support ring 406 with its lower portion being inserted in the support pipe 404. The other end of the chain 410 is disconnected from the screw 407 of the support ring 406 and is wrapped around the insertion pipe 410 at a position higher than the support pin 412 (see FIG. 33). The rotary operation handle 418 is operated to move the support ring 406 in the axial direction (up-and-down direction) with respect to the support pipe 404. Due to this motion, the support pin 412 moves along the pair of elongated holes 416, and the insertion pipe 410 and the receiving plate 408 move at the same time. Thus, the insertion pipe 410, i.e., the receiving plate 408 is adjusted to a predetermined height. A slab form is assembled at the upper portion of the receiving plate 408, and concrete is poured (neither of them is illustrated).

When a predetermined period of time has passed after the concrete has been poured, the support 400 must be removed from the slab form. The rotary operation handle 418 is operated to downwardly move the insertion pipe 410. Thus the receiving plate 408 is downwardly separated from the slab form. After the slab form is removed, the support pin 412 is removed from the pair of pin holes 422 and pair of elongated holes 416 in a state where the insertion pipe 410 is slightly lifted up with respect to the support pipe 404. The insertion pipe 410 is permitted to fall; i.e., the insertion pipe 410 is deeply inserted in the support pipe 404 and is accommodated therein.

The conventional support 400 that is constituted and is used as briefly described above, however, involves the following problems that must be solved.

(1) A heavy load of the concrete is exerted on the support 400 in a state where the concrete has been poured into the slab flask. The heavy load acts on the upper end surface of the support ring 406 via the receiving plate 408, insertion pipe 410 and both ends of the support pin 412. For downwardly moving the insertion pipe 410 in a state where the heavy load of a heavy material is acting on the support 400, the support ring 406 must be turned. As described above, however, the heavy load is directly exerted on the upper end surface of the support ring 406 via both ends of the support pin 412, and a large frictional force must be overcome in order to turn the support ring 406. One rotary operation handle 418 is fitted to the outer peripheral portion of the support ring 406. To turn the support ring 406, therefore, the rotary operation handle 418 must be turned by one hand. In many cases, in practice, it is difficult to turn the support ring 406 by hand. In such a case, the rotary operation handle 418 is forcibly turned by being hit by a hammer or the like. As a result, this sometimes causes the rotary operation handle 418 to be damaged or broken and the threaded portions of the support pipe 404 and the support ring 406 to be broken.

(2) As described above, the support 400 is chiefly used for constructing the molding form for molding the slab concrete. That is, the support 400 is used in a form to receive the load acting on the receiving plate 408 of the insertion pipe 410 adjusted to a predetermined height by the upper end surface of the support ring 406 via the support pin 412. Therefore, the support 400 can be used as a support member (strut member) but cannot be used as a pull support member.

(3) The support pin 412 is coupled by a chain 420 to the outer peripheral portion of the support ring 406. This is to prevent the support pin 412 from being lost. However, the presence of a relatively long chain 420 impairs the operability of when either the support pin 412 is used or is not used. When the support pin 412 is used, or in other words, at the time of adjusting the height, the support pin 412 is inserted in a pair of pin holes 422 of the insertion pipe 410. Then, in order that the rotation of the support ring 406 will not be interrupted, one end of the chain 420 must be removed from the screw 407 of the support ring 406 and must be wrapped around the insertion pipe 410 at a position higher than the support pin 412. When the support ring 406 is turned in this state, however, the chain 420 that is wrapped around may often be untied due to the motion of the support pin 412. Furthermore, when the support pin 412 is not in use it is coupled by the chain 420 to the screw 407 of the support ring 406 in a hanging state. In this state, however, the support ring 406 cannot be smoothly turned, i.e., the operability is poor.

(4) The support 400 is constituted in two stages by the support pipe 404 and the insertion pipe 410 inserted therein. In order to heighten the support 400 in this constitution, the support pipe 404 and the insertion pipe 410 must be lengthened in the axial direction, respectively. With this constitution, however, a problem arises in the safety of the support 400 as a whole. Therefore, the practicable height of the support cannot be so increased. That is, the support 400 is not capable of stably supporting the load at a high position.

SUMMARY OF THE INVENTION

It is an object of the present invention to provide an improved support that permits a support ring means to be easily turned even in a state where a heavy load is exerted.

Another object of the present invention is to provide an improved support that can be utilized as a pull support member.

A further object of the present invention is to provide an improved support that is capable of reliably preventing the support pin from being lost without impairing the operation for turning the support ring means.

A still further object of the present invention is to provide an improved support that is capable of stably supporting the load at a relatively high position.

According to one aspect of the present invention, there is provided a support comprising a support pipe means having an external thread formed at an upper end portion thereof, a support ring means having an internal thread formed therein and being allowed to move in the axial direction with its internal thread being engaged with the external thread of the support pipe means, an insertion pipe means of which the lower end portion is movably inserted in the support pipe means and which has plural pairs of pin holes that are formed at intervals in the direction of axis thereof and penetrate from the outer peripheral surface on one side thereof to the outer peripheral surface on the other side thereof, and a support pin that can be removably inserted in each of the pairs of pin holes, a rotary operation handle means being fitted to the support ring means, a pair of elongated holes being formed in the externally threaded portion of the support pipe means where the external thread is formed penetrating from the outer peripheral surface on one side thereof to the outer peripheral surface on the other side thereof and extending in the direction of the axis, the support pin having such a length that both ends thereof protrude beyond the pair of elongated holes when it is inserted in one of the pairs of pin holes of the insertion pipe means through the pair of elongated holes formed in the support pipe means in a state where the insertion pipe means is inserted in the support pipe means, the insertion pipe means being supported by the support pipe means in a manner such that its height can be adjusted as each end of the support pin is placed on the upper end surface of the support ring means, wherein the support ring means comprises a main support ring member having the internal thread formed in the inner peripheral portion thereof and an upper support ring member that is rotatably coupled to the upper end of the main support ring member via an upper thrust bearing means, and the rotary operation handle is fitted to the outer peripheral portion of the main support ring member.

According to another aspect of the present invention, there is provided a support comprising a support pipe means having an external thread formed at an upper end portion thereof, a support ring means having an internal thread formed therein and being allowed to move in the axial direction with its internal thread being engaged with the external thread of the support pipe means, an insertion pipe means of which the lower end portion is movably inserted in the support pipe means and which has plural pairs of pin holes that are formed at intervals in the axial direction of and penetrate from the outer peripheral surface on one side thereof to the outer peripheral surface on the other side thereof, and a support pin that can be removably inserted in each of the pairs of pin holes, a rotary operation handle means being fitted to the support ring means, a pair of elongated holes being formed in the externally threaded portion of the support pipe means where the external thread is formed penetrating from the outer peripheral surface on one side thereof to the outer peripheral surface on the other side thereof and extending in the axial direction the support pin having such a length that both ends thereof protrude beyond the pair of elongated holes when it is inserted in one of the pairs of pin holes of the insertion pipe means through the pair of elongated holes formed in the support pipe means in a state where the insertion pipe means is inserted in the support pipe means, and the insertion pipe means being supported by the support pipe means in a manner such that its height can be adjusted as each end of the support pin is placed on the upper end surface of the support ring means, wherein the support ring means comprises a main support ring member having the internal thread formed in the inner peripheral portion thereof, an upper support ring member that is rotatably coupled to the upper end of the main support ring member via an upper thrust bearing means and a lower support ring member that is rotatably coupled to the lower end of the main support ring member via a lower thrust bearing means, and the rotary operation handle is fitted to the outer peripheral portion of the main support ring member.

According to a further aspect of the present invention, there is provided a support comprising a support pipe means having an external thread formed at an upper end portion thereof, a support ring means having an internal thread formed therein and being allowed to move in the axial direction with its internal thread being engaged with the external thread of the support pipe means, an insertion pipe means of which the lower end portion is movably inserted in the support pipe means and which has plural pairs of pin holes that are formed at intervals in the axial direction of axis and penetrate from the outer peripheral surface on one side thereof to the outer peripheral surface on the other side thereof, and a support pin that can be removably inserted in each of the pairs of pin holes, a rotary operation handle means being fitted to the support ring means, a pair of elongated holes being formed in the externally threaded portion of the support pipe means where the external thread is formed penetrating from the outer peripheral surface on one side thereof to the outer peripheral surface on the other side thereof and extending in the axial direction, the support pin having such a length that both ends thereof protrude beyond the pair of elongated holes when it is inserted in one of the pairs of pin holes of the insertion pipe means through the pair of elongated holes formed in the support pipe means in a state where the insertion pipe means is inserted in the support pipe means, and the insertion pipe means being supported by the support pipe means in a manner that such its height can be adjusted as each end of the support pin is placed on the upper end surface of the support ring means, wherein the rotary operation handle means of said support ring means includes at least one rotary operation handle of which the one end is rotatably supported by the outer peripheral portion of the support ring means, the rotary operation handle is constituted by a round pipe member and has an internal thread means formed in the inner peripheral portion at the other end portion thereof, an external thread is formed at an end portion of the support pin, a plate portion is formed in a portion at one end of the external thread portion, the plate portion having a width at its both sides that is larger than the outer diameter of the support pin, and the support pin is inserted in the rotary operation handle from the side of the other end thereof in a manner that the other end side of the external thread of the support pin is engaged with the internal thread means of the rotary operation handle so as to be removably held by the rotary operation handle.

According to a still further aspect of the present invention, there is provided a support comprising a support pipe means having an external thread formed at an upper end portion thereof, a support ring means having an internal thread formed therein and being allowed to move in the axial direction with its internal thread being engaged with the external thread of the support pipe means, an insertion pipe means of which the lower end portion is movably inserted in the support pipe means and which has plural pairs of pin holes that are formed at intervals in the axial direction and penetrate from the outer peripheral surface on one side thereof to the outer peripheral surface on the other side thereof, and a support pin that can be removably inserted in each of the pairs of pin holes, a rotary operation handle means being fitted to the support ring means, a pair of elongated holes being formed in the externally threaded portion of the support pipe means where the external thread is formed penetrating from the outer peripheral surface on one side thereof to the outer peripheral surface on the other side thereof and extending in the axial direction the support pin having such a length that both ends thereof protrude beyond the pair of elongated holes when it is inserted in one of the pairs of pin holes of the insertion pipe means through the pair of elongated holes formed in the support pipe means in a state where the insertion pipe means is inserted in the support pipe means, the insertion pipe means being supported by the support pipe means in a manner such that its height can be adjusted as each end of the support pin is placed on the upper end surface of the support ring means, wherein said support is provided with a plurality of insertion pipe means including the insertion pipe means that will be inserted in the support pipe means, plural pairs of pin holes are formed at intervals in the axial direction, also in the insertion pipe means other than the insertion pipe means inserted in the support pipe means, the pairs of pin holes penetrating from the outer peripheral surface on one side thereof to the outer peripheral surface on the other side thereof, each of the insertion pipe means is so constituted that the lower end side of the insertion pipe means of the upper side is inserted in the upper end side of the insertion pipe means of the lower side, the pairs of pin holes of the insertion pipe means of the upper side are so defined for their positions as to be in match with the pairs of pin holes of the insertion pipe means of the lower side at the inserted portion, axes of the pairs of pin holes formed in the insertion pipe means are arranged to be deviated by 90° relative to each other in the circumferential direction, and at least two support pins are removably inserted in their corresponding pairs of pin holes being deviated by 90° in a state where the insertion pipe means of the upper side is inserted in the insertion pipe means of the lower side and pairs of pin holes of the insertion pipe means of the upper side are brought into match with the pairs of pin holes of the insertion pipe means of the lower side in the inserted portion, so that the insertion pipe means of the upper side is supported by the insertion pipe means of the lower side.

According to an aspect of the present invention, the support ring means comprises a main support ring member having an internal thread formed in the inner periphery thereof and an upper support ring member that is rotatably coupled to the upper end of the main support ring member via an upper thrust bearing means. The rotary operation handle means is fitted to the outer peripheral portion of the main support ring member. The insertion pipe means is inserted in the support ring means and the support pin is inserted in the pair of elongated holes and in the pair of pin holes on the upper side of the support ring means, whereby both ends of the support pin are placed on the upper end surface of the upper support ring member. Thus, the insertion pipe means is supported by the support pipe means maintaining the freedom of adjusting the height. In order to downwardly move the insertion pipe means in a state where a heavy load such as of a concrete slab is exerted on the insertion pipe means, therefore, the main support ring member is rotated by using the rotary operation handle means. The upper support ring member does not rotate since the heavy load is exerted on the upper end surface thereof via both ends of the support pin. Owing to the function of the upper thrust bearing means interposed between the main support ring member and the upper support ring member, however, the main support ring member only can be very easily turned by hand. Even under the condition where a heavy load is exerted, therefore, the main support ring can be turned very easily and the insertion pipe means can be easily moved downwards.

In the present invention, as described above, the insertion pipe means is placed on the upper end surface of the upper support ring member via the support pin so as to be supported maintaining the freedom of adjusting the height (the length in the axial direction is adjustable). This function is chiefly adapted for constructing the form of the slab concrete, but can be further used as a support member or a strut member (holding member). That is, by turning the main support ring member, the insertion pipe means extends in the axial direction relative to the support pipe means. Therefore, the support is disposed between the mounting surface and a member that is to be supported or between a member that is to be supported and another member that is to be supported, and the insertion pipe means is extended in the axial direction. Thus, the support can be favorably used as a support member or as a strut member. The support can be disposed not only in the vertical direction but also in the horizontal direction or in an oblique direction. In this case, owing to the function of the upper thrust bearing means, the main support ring member can be easily rotated even against the heavy load and, hence, the strut operation (extension operation) can be very easily carried out or can be very easily discontinued.

According to another aspect of the present invention, the support ring means is equipped with a main support ring member having an internal thread that is formed in the inner peripheral portion thereof, an upper support ring member rotatably coupled to the upper end of the main support ring member via an upper thrust bearing means, and a lower support ring member coupled to the lower end of the main support ring member via a lower thrust bearing means. A rotary operation handle means is mounted on the outer peripheral portion of the main support ring member.

The support ring means of the support is equipped with the main support ring member and with the upper support ring member rotatably coupled to the upper end of the main support ring member via the upper thrust bearing means, and exhibits the same actions and effects as those mentioned above.

The support ring means of this support is further equipped with the lower support ring member rotatably coupled to the lower end of the main support ring member via the lower thrust bearing means. As the support pin is inserted through the pair of elongated holes and the pair of pin holes on the lower side of the support ring means, therefore, both ends of the support pin are positioned on the side of the lower end surface of the lower support ring member. Therefore, the support can be favorably used as a pull support member. That is, one end of the support pipe means is secured to the mounting surface, the upper end of the insertion pipe means is engaged with a member that is to be pulled, and the main support ring member is rotated. Then, the insertion pipe means is contracted in the axial direction relative to the support pipe means, and the member to be pulled is pulled with respect to the mounting surface. In this case, owing to the function of the lower thrust bearing means, the main support ring member can be easily rotated even against the heavy load, and the pulling operation and the operation for discontinuing the pulling can be carried out very easily.

According to a further aspect of the present invention, the rotary operation handle is constituted by a round pipe member and has an internal thread means formed in the inner periphery thereof at the other end. An external thread is formed at one end of the support pin, and a plate portion is formed on a portion at an end of the external thread portion, the plate portion having a width at both sides thereof which is larger than the outer diameter of the support pin. The support pin is inserted in the rotary operation handle from the side of the other end thereof and the other end of the external thread portion of the support pin engages with the internal thread means of the rotary operation handle, and is thus detachably held by the rotary operation handle. Therefore, the support pin that is not in use is inserted in the rotary operation handle and is simply turned so as to be screwed and is accommodated therein. Thus, the support pin is reliably prevented from being lost. Unlike the prior art, furthermore, a chain is not used to prevent the support pin from being lost. Accordingly, the support ring means can be smoothly rotated without impaired by the chain.

According to a still further aspect of the present invention, the support is provided with a plurality of insertion pipe means including insertion pipe means that will be inserted in the support pipe means. Plural pairs of pin holes are formed also in the insertion pipe means other than the insertion pipe means inserted in the support pipe means, the plural pairs of pin holes that are formed at intervals in the axial direction and penetrate from the outer peripheral surface on one side thereof to the outer peripheral surface on the other side thereof. Each of the insertion pipe means is so constituted that the lower end side of the insertion pipe means of the upper side is inserted in the upper end side of the insertion pipe means of the lower side, and pairs of pin holes of the insertion pipe means of the upper side are so defined for their positions as to be in match with the pairs of pin holes of the insertion pipe means of the lower side at the inserted portion. Axes of the pairs of pin holes formed in the insertion pipe means are arranged being deviated by 90° relative to each other in the circumferential direction. At least two support pins are removably inserted in their corresponding pairs of pin holes being deviated by 90° in a state where the insertion pipe means of the upper side is inserted in the insertion pipe means of the lower side and pairs of pin holes of the insertion pipe means of the upper side are brought into match with the pairs of pin holes of the insertion pipe means of the lower side in the inserted portion, so that the insertion pipe means of the upper side is supported by the insertion pipe means of the lower side. Therefore, deviation of the insertion pipe means of the upper side relative to the insertion pipe means of the lower side is reliably blocked by at least two support pins in the two directions that intersect at right angles with each other. Accordingly, even when a plurality of insertion pipe means, for example, two to four insertion pipe means are connected, deviation is prevented in each of the insertion portions and the load at a relatively high position is stably supported. It is important that at least two support pins are inserted in the pairs of pin holes that are located being deviated by 90° relative to each other. The support pins may be inserted in the pairs of pin holes that are neighboring in the axial direction or may be inserted in the pairs of pin holes that are separated apart in the axial direction. The deviation can be prevented more effectively and the support strength can be increased as the support pins are used in an increased number.

BRIEF DESCRIPTION OF THE DRAWINGS

FIG. 17 is viewed from the right side;

DETAILED DESCRIPTION OF THE PREFERRED EMBODIMENTS

Embodiments of a support improved according to the present invention will now be described in detail with reference to the accompanying drawings.

Figure 1:
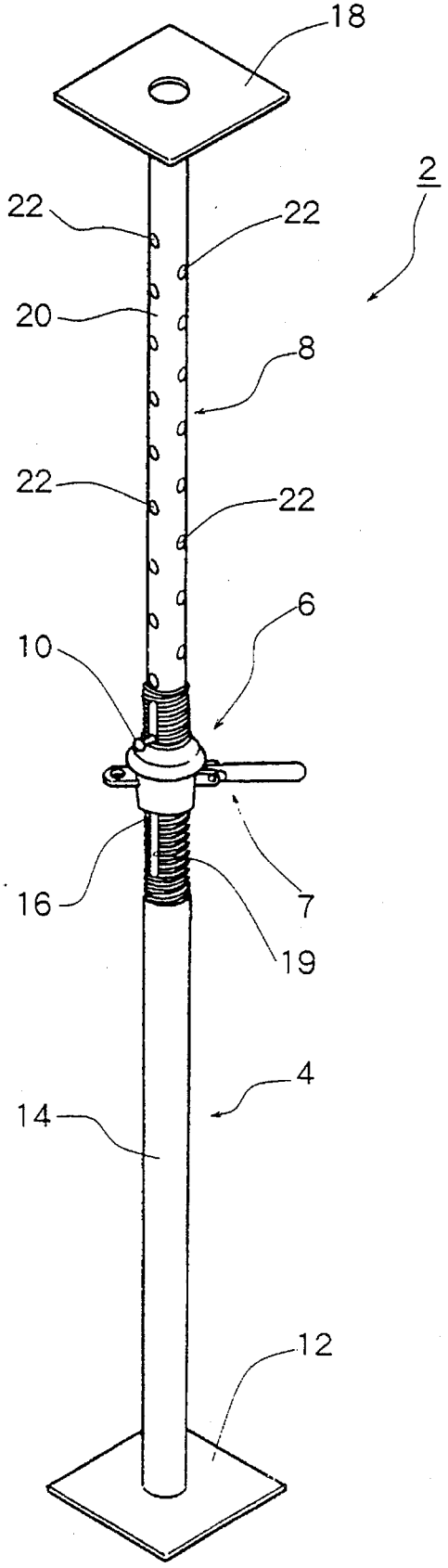
FIG. 1 is a perspective view illustrating a support improved according to an embodiment of the present invention.
Figure 2:
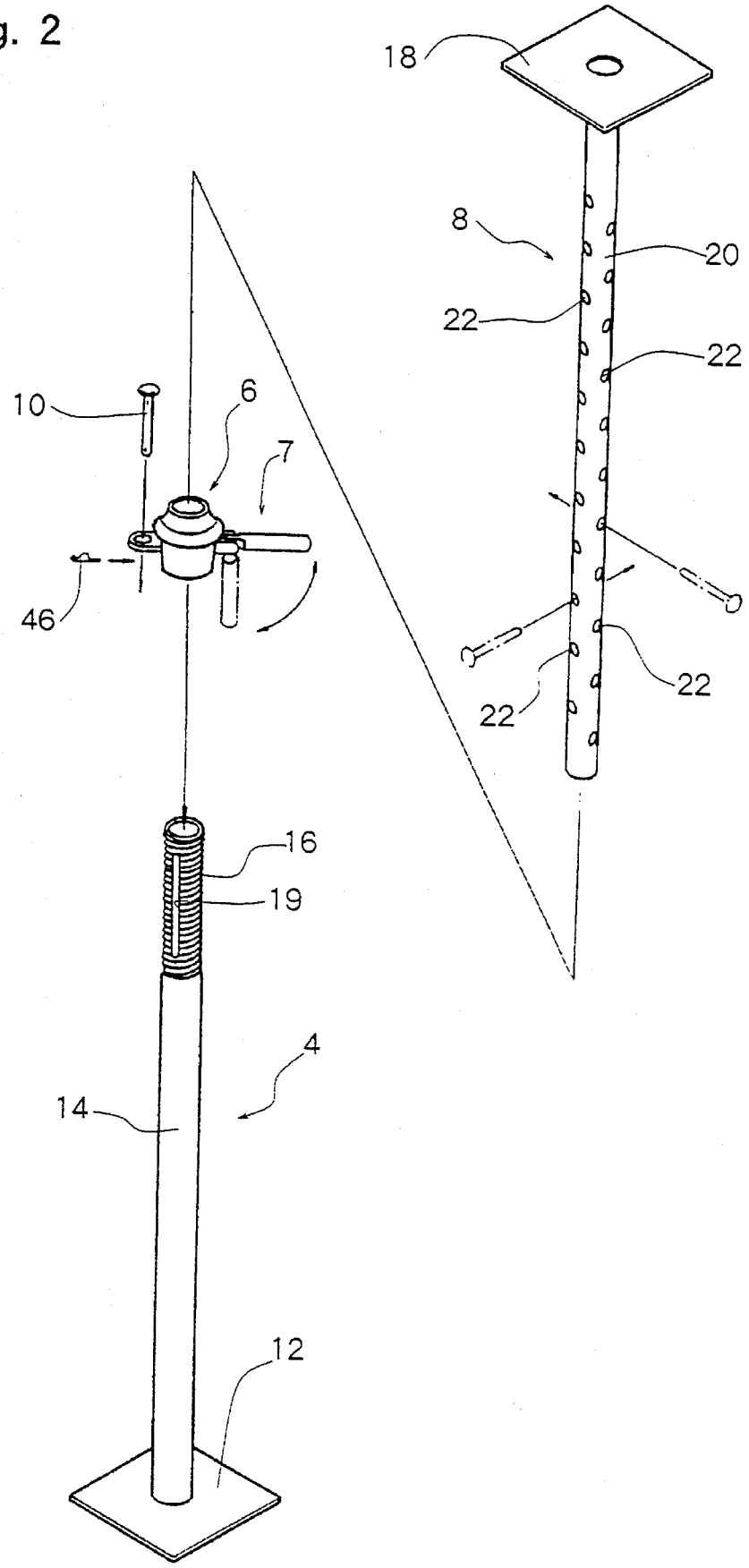
FIG. 2 is a perspective view illustrating the support of FIG. 1 in a disassembled manner.
Figure 3:
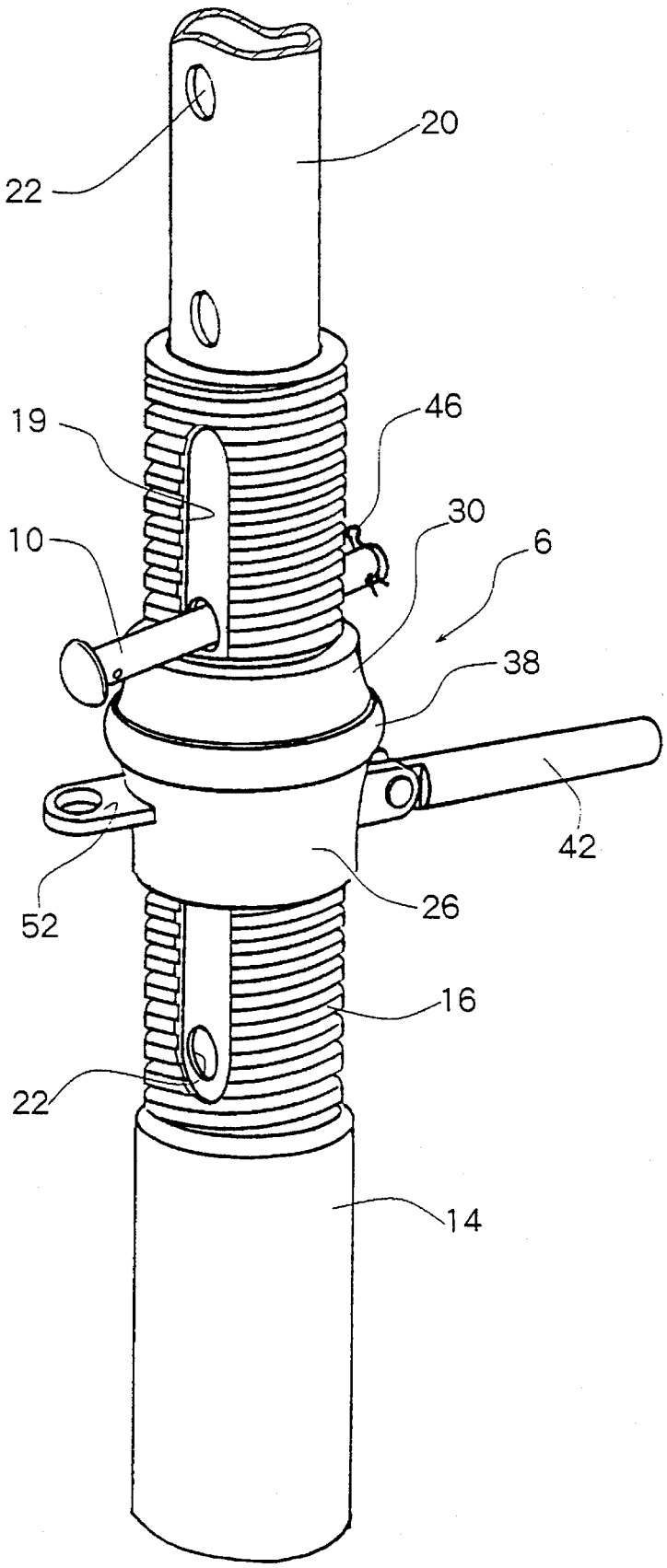
FIG. 3 is a perspective view illustrating, on an enlarged scale, a major portion of the support that is shown in FIG. 1.

With reference to FIGS. 1 to 3, a support 2 includes a support pipe means 4, a support ring means 6, an insertion pipe means 8 and a support pin 10. The support pipe means 4 includes a base 12 and a support pipe 14 which is coupled at its lower end to the base 12. A pair of elongated holes 19 are formed in the external thread portion of the support pipe 14, where an external thread 16 is formed, penetrating from the outer peripheral surface on one side thereof to the other side thereof and extending in the axial direction. FIG. 1 shows only one of the pair of elongated holes 19. The support ring means 6 which will be described later in detail has an internal thread formed in the inner periphery thereof and is engaged with the external thread 16 of the support pipe 14 via the internal thread so as to be movable in the axial direction relative to the support pipe 14. A rotary operation handle means 7 is mounted on the support ring means 6.

The insertion pipe means 8 includes a receiving plate 18 and an insertion pipe 20 which is coupled at its upper end to the receiving plate 18. The insertion pipe 20 is inserted in the support pipe 4 so as to move in the axial direction thereof. The insertion pipe 20 has plural pairs of pin holes 22 that are formed at intervals in the axial direction and penetrate from one side of the peripheral surface thereof to the other side of the peripheral surface thereof. Axes of the pairs of pin holes 22 are arranged being alternately deviated by 90 degrees in the axial direction of the insertion pipe 20. Each pair of pin holes 22 has an axis that makes a right angle with the axis of the insertion pipe 20. The gap (pitch) in the axial direction of the pairs of pin holes 22 is substantially the same as that of the insertion pipe 20. This constitution is reasonable for shortening the gap among the pairs of pin holes 22 and is further advantageous from the standpoint of strength of the insertion pipe 20. The insertion pipe 20 may be constituted by a solid rod member. Therefore, the insertion pipe means 8 includes also such a constitution. In the case of this constitution, the pairs of pin holes 22 having the same axis are those pin holes 22 having the same axis. The pairs of pin holes 22 formed in the insertion pipe 20 stand for also pin holes 22 that are formed in the solid rod member.

The support pin 10 is constituted such that it can be removably inserted in each of the pairs of pin holes 22 of the insertion pipe 20. The support pin 10 has such a length that both ends thereof protrude beyond the pair of elongated holes 19 when it is inserted in one of the pairs of pin holes 22 of the insertion pipe 20 through the pair of elongated holes 19 of the support pipe 14 in a state where the insertion pipe 20 is inserted in the support pipe 14. As both ends of the support pin 10 are placed on the upper end surface of the support ring means 6, the insertion pipe 20 is supported by the support pipe means 4 maintaining the freedom of adjusting its height.

Figure 4:
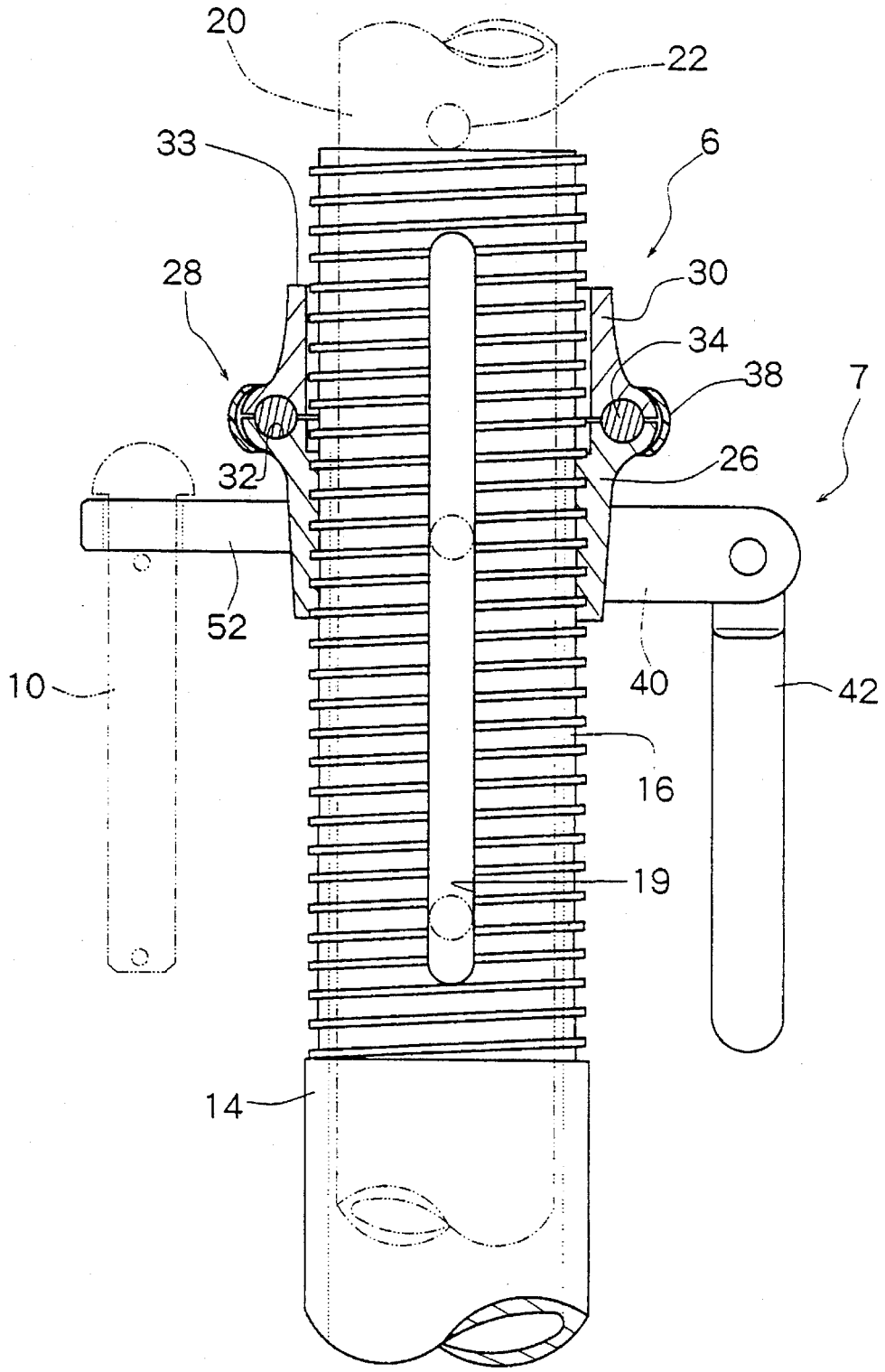
FIG. 4 is a view showing the major portion of the support of FIG. 1 partly in cross section.
Figure 5:
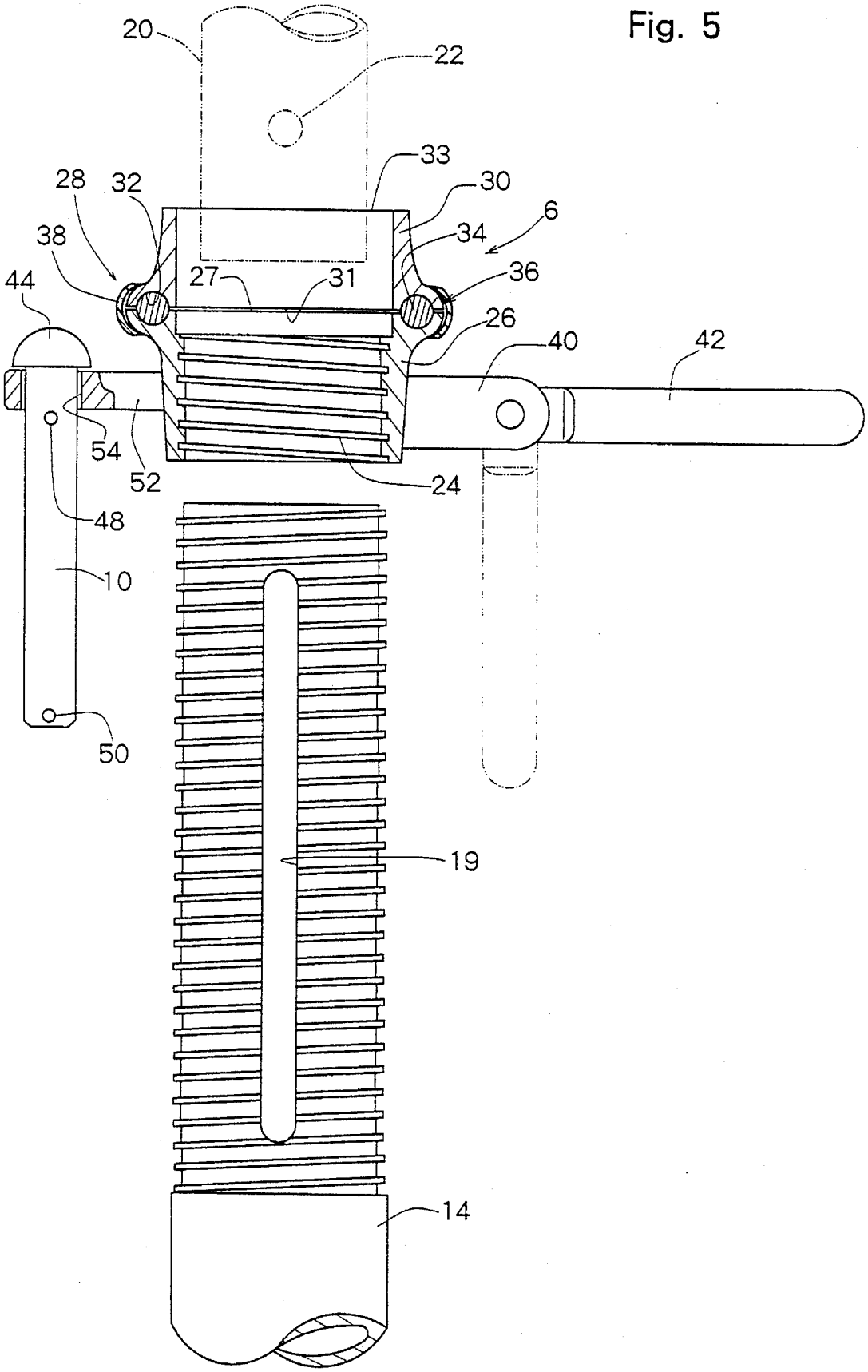
FIG. 5 is a sectional view illustrating the major portion of the support of FIG. 4 in a disassembled manner.
Figure 6:
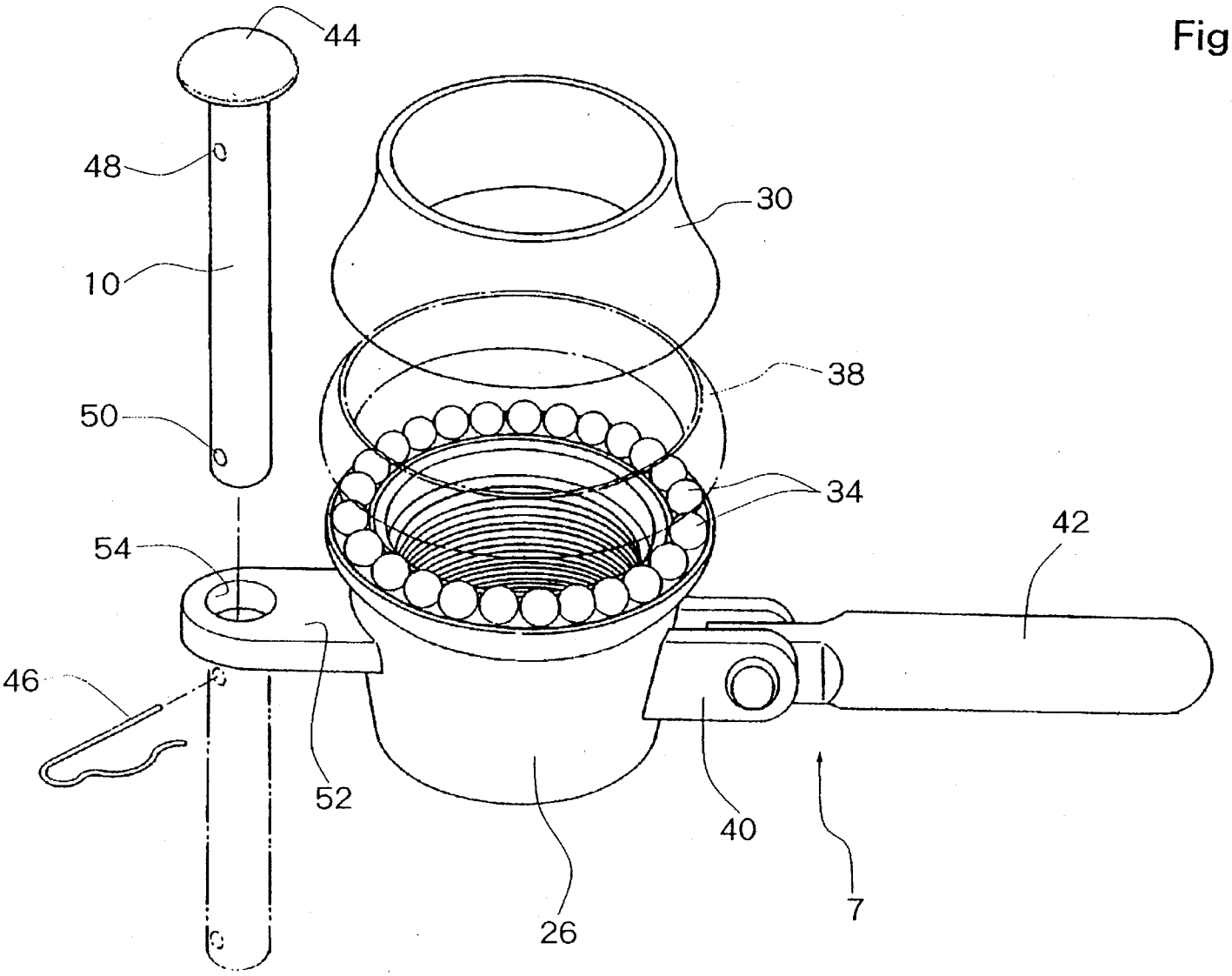
FIG. 6 is a perspective view schematically illustrating the major portion of the support of FIG. 5 partly in a disassembled manner.

With reference to FIGS. 4 to 6, the support ring means 6 includes a main support ring member 26 having an internal thread 24 formed in the inner peripheral portion thereof, and an upper support ring member 30 rotatably coupled to the main support ring member 26 via an upper thrust bearing means 28. The rotary operation handle means 7 is mounted on the outer peripheral portion of the main support ring member 26. Both the main support ring member 26 and the upper support ring member 30 have a cylindrical form, the main support ring member 26 having the internal thread 24 formed in the inner peripheral portion thereof. The inner peripheral surface of the upper support ring member 30, however, is simply a cylindrical surface.

The thrust bearing means 28 is constituted by an annular groove 32 formed between a lower end surface 31 of the upper support ring member 30 and an upper end surface 27 of the main support ring member 26 in a state where the lower end surface 31 and the upper end surface 27 are opposed to each other maintaining a gap, a plurality of balls 34 rotatably inserted in the annular groove 32, an annular protruded portion 36 that is continuously formed between an outer peripheral surface at the lower end defined by the lower end surface 31 of the upper support ring member 30 and an outer peripheral surface at the upper end defined by the upper end surface 27 of the main support ring member 26 that are located maintaining a gap, and an annular retainer member 38 that is slidably fitted to the circumference of the protruded portion 36 so as to cover the gap. The outer peripheral surface of the protruded portion has a substantially arcuate shape in cross section. The annular retainer member 38 can be easily mounted by fitting a ring-like metal plate having a predetermined width to the outer peripheral surface of the protruded portion 36 and, then, drawing the metal plate to meet the outer peripheral surface of the protruded portion 36. This makes it possible to rotatably couple the upper support ring member 30 and the main support ring member 26 together via balls 34. On the outer peripheral portion of the main support ring member 26 is provided a support portion 40 that outwardly protrudes in the radial direction, and an operation handle 42 is supported by the support portion 40 so as to rotatably move between a horizontal position and a vertical position. The rotary operation handle means 7 is constituted by the support portion 40 and the operation handle In a state where the insertion pipe 20 is inserted in the support pipe 14 and both ends of the support pin 10 inserted in one of the pair of elongated holes 19 and in one of the pairs of pin holes 22 are placed on the upper end surface 33 of the upper support ring member 30 of the support ring means 6 engaged with the support pipe 14, the insertion pipe 20 is supported by the support pipe maintaining the freedom of adjusting the height.

With reference to FIGS. 3 to 6, the support pin 10 has a head portion 44 formed at an end thereof and a through hole 48 at a portion close to the head portion 44 in which be inserted a cotter pin 46. The support pin 10 has another through hole 50 formed at the other end portion thereof in which will be inserted the cotter pin 46. On the outer peripheral portion of the main support ring member 26 is provided a holding portion 52 which outwardly protrudes in the radial direction, and a pin hole 54 is formed in the holding portion 52. In a state in which the support pin 10 is inserted in the pin hole 54 of the holding portion 52 from the end on one side thereof (upper side), the through hole 48 is located on the other side (lower side) of the pin hole The support pin 10 is held by the holding portion 52 so as not to escape thanks to the head portion 44 and the cotter pin 46 inserted in the through hole 48. In a state in which the support pin 10 is inserted in the pair of elongated holes 19 of the support pipe and in the pair of pin holes 22 of the insertion pipe 20, furthermore, the support pin 10 is prevented from being removed from the pair of pin holes 22 thanks to the head portion 44 and the cotter pin 46 inserted in the other through hole 50.

In order to downwardly move the insertion pipe 20 in a state where a heavy load such as of a concrete slab 336 (see FIG. 23) is exerted on the insertion pipe 20, the main support ring member 26 is rotated by using the rotary operation handle 42. The upper support ring member 30 does not rotate since the heavy load is acting upon the upper end surface 33 thereof via both ends of the support pin 10. However, the main support ring member 26 alone can be easily rotated by hand owing to the function of the upper thrust bearing means 28 interposed between the main support ring member 26 and the upper support ring member 30. Even in a state where the heavy load is acting, therefore, the main support ring member 26 can be rotated very easily, and the insertion pipe 20 is easily moved downwards. As a matter of course, the insertion pipe 20 can be easily moved upwards even in a state where the heavy load is exerted thereon.

As described above, the support 2 does not have the chain 120 that is used in the prior art but uses the cotter pin 46 in its place. When the support pin 10 is not in use (see FIG. 5), the cotter pin 46 is inserted in the through hole 48; i.e., the support pin 10 is prevented from escaping from the holding portion 52 and the cotter pin 46 is prevented from being lost, too. When the support pin 10 is in use, the cotter pin 46 is inserted in the through hole 50; i.e., the support pin 10 is prevented from escaping from the pin holes 22 and the cotter pin 46 is prevented from being lost, too. The operation as a whole is very easy, and the operation for rotating the main support ring 26 is not at all impaired. As a result, the operation efficiency is markedly improved either when the support pin 10 is in use or is not in use.

Figure 7:
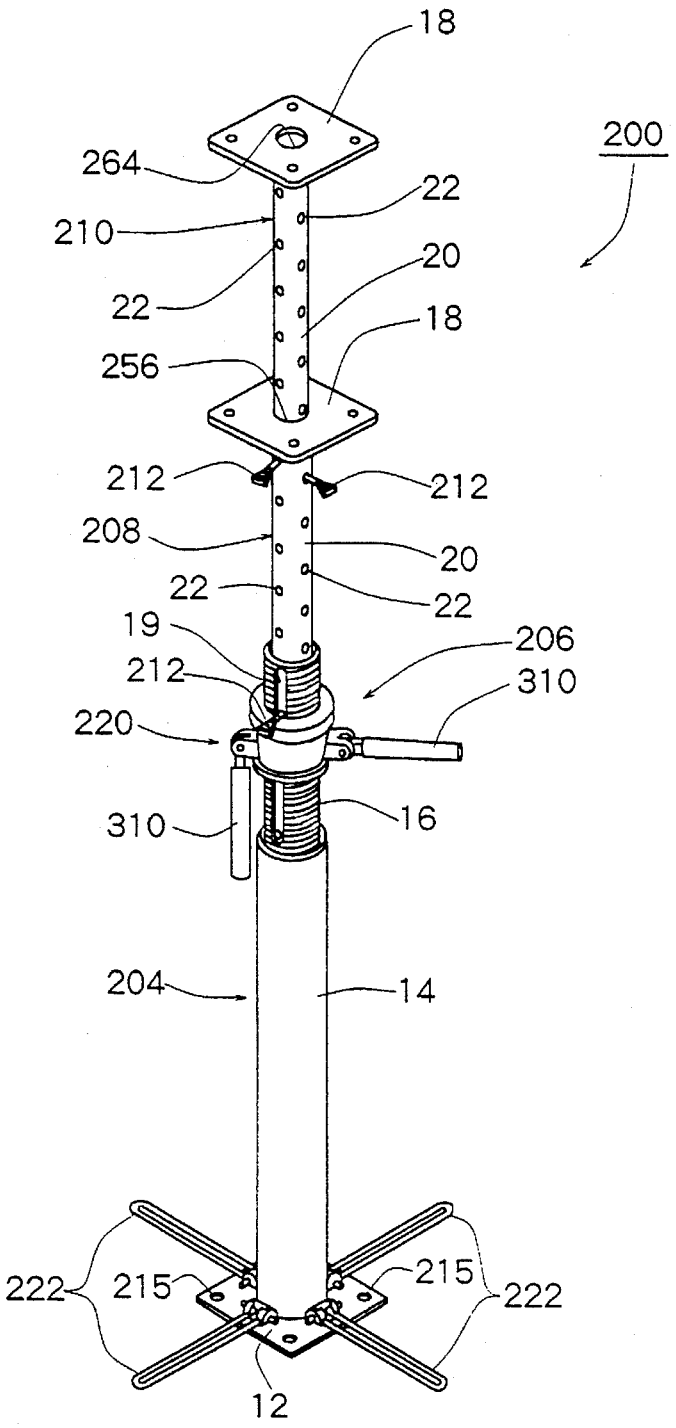
FIG. 7 is a perspective view illustrating the support improved according to another embodiment of the present invention.

Described below is the support improved according to another embodiment of the present invention. With reference to FIG. 7, a support 200 includes a support pipe means 204, a support ring means 206, insertion pipe means 208 and 210, and support pins 212. The support pipe means 204 has substantially the same constitution as the support pipe means 4 of the support 2 that is shown in FIG. 1 with the exception of the provision of auxiliary support members 222 that will be described later. Therefore, the same portions are denoted by the same reference numerals and their description is not repeated. As will be described later, the support ring means 206 is provided with a rotary operation handle means 220.

The base 12 of the support pipe means 204 is made of a plate member of a square shape. The base 12 has holes 215 formed at four corners for mounting onto the mounting surface.

Figure 9:
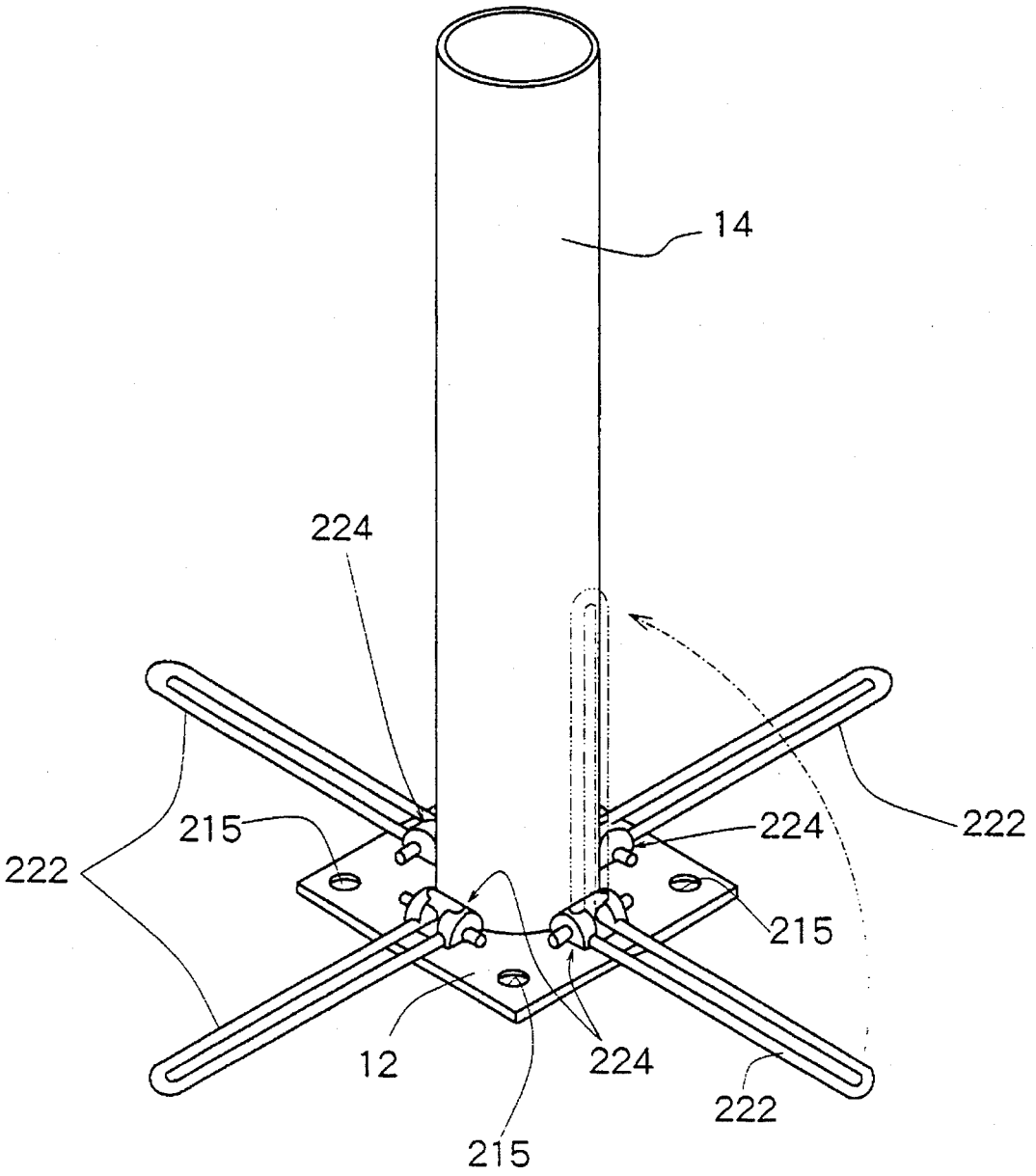
FIG. 9 is a perspective view illustrating a state where an auxiliary support member provided for the supports of FIGS. 7 and 8 is mounted.

Referring to FIG. 9 together with FIG. 7, auxiliary support members 222 are provided at four places on the base 12. The auxiliary support members 222 are pivotally mounted at one end thereof, and are selectively brought to use positions (indicated by solid lines in FIG. 9) at which they are outwardly protruded substantially horizontally and to non-use positions (indicated by a two-dot chain line in FIG. 9) at which they are folded to extend along the support pipe 14. Each auxiliary support member 222 is made of a rod member which as a whole is slender and is folded substantially in a U-shape, and its open ends are folded in the positions opposite to each other. Support portions 224 for pivotally supporting the auxiliary support members 222 are provided at four places on the base 12. Each support portion 224 has a pair of holes for pivotally supporting the holding portions of the corresponding auxiliary support member 222, a pair of anchoring grooves for anchoring the auxiliary support member 222 at the use position, and another pair of anchoring grooves for anchoring the auxiliary support member 222 at the non-use position. Each auxiliary support member 222 is inserted in, and supported by, the pair of holes of the corresponding support portion 224 in a state where the folded portions maintain a resilient force in a direction to separate away from each other, and is anchored in either pair of anchoring grooves. Therefore, the auxiliary support member 222 is deflected toward a direction to narrow its gap and is liberated from either pair of anchoring grooves, and is turned about the pair of holes and is, then, anchored in another pair of anchoring grooves due to its resilient force. The auxiliary support members 222 can thus be selectively brought to the use positions and the non-use positions. By bringing the auxiliary support members 222 to the use positions, a well-balanced and stable support is guaranteed. When the auxiliary support members 222 are brought to the non-use positions, the support becomes compact lending itself well for being transported and stored.

Figure 10:
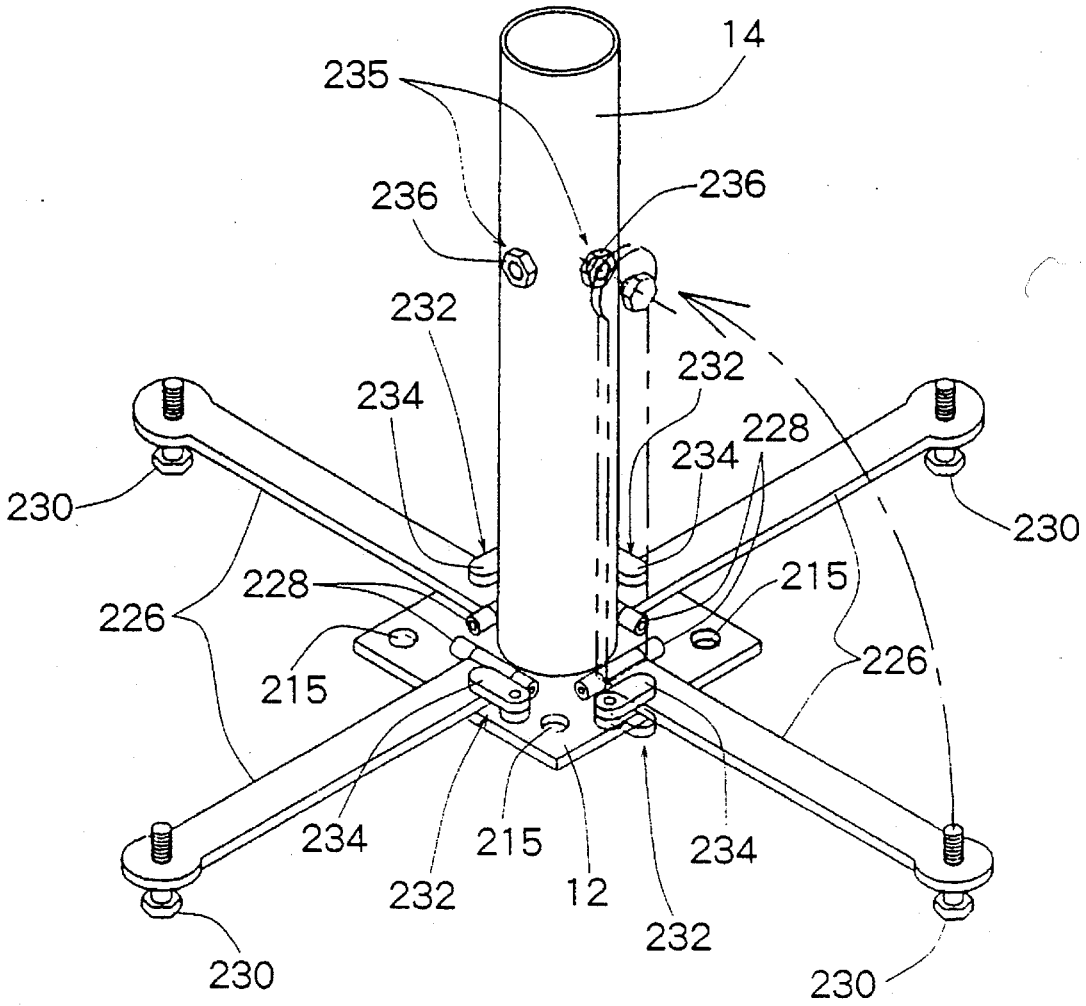
FIG. 10 is a perspective view illustrating the state where the auxiliary support member according to another embodiment is mounted.

FIG. 10 illustrates other auxiliary support members 226 different from the above-mentioned auxiliary support members 222. Each auxiliary support member 226 is constituted by a slender plate member and is pivotally supported at its one end on the base 12 via a hinge 228. A bolt 230 is engaged at the other end of the auxiliary support member 226 being directed from the lower side to the upper side. Each auxiliary support member 226 is selectively brought to the use position (indicated by a solid line in FIG. 10) at which it protrudes outwardly of the base 12 substantially horizontally with the hinge 228 as a center and to the non-use position (indicated by a two-dot chain line in FIG. 10) where it is folded to extend along the support pipe 14. Holding fittings 232 are provided at four places of the base 12 to hold the auxiliary support members 226 at the use positions. Each holding fitting 232 has a holding plate 234 that is horizontally and rotatably provided on the base 12 at a distance. The holding plates 234 are turned onto the auxiliary support members 226 at the use positions, whereby the auxiliary support members 226 are prevented from upwardly pivoting and are held at the use positions. By sidewardly turning the holding plates 234 from over the auxiliary support members 226, the auxiliary support members 226 are allowed to turn upwardly. Holding portions 235 are provided at four outer peripheral portions on the lower side of the support pipe 14 with which the auxiliary support members 226 can be held at the non-use positions. The holding portions 235 are each constituted by a through hole that is not shown and a nut 236 that is secured to the outer peripheral portion to be in match with the through hole. When the auxiliary support members 226 are upwardly turned, the threaded portions of the bolts 230 are brought into match with the corresponding nuts 236. By bringing the bolts 230 into engagement with the corresponding nuts 236, the auxiliary support members 226 can be held at the non-use positions.

Figure 11:
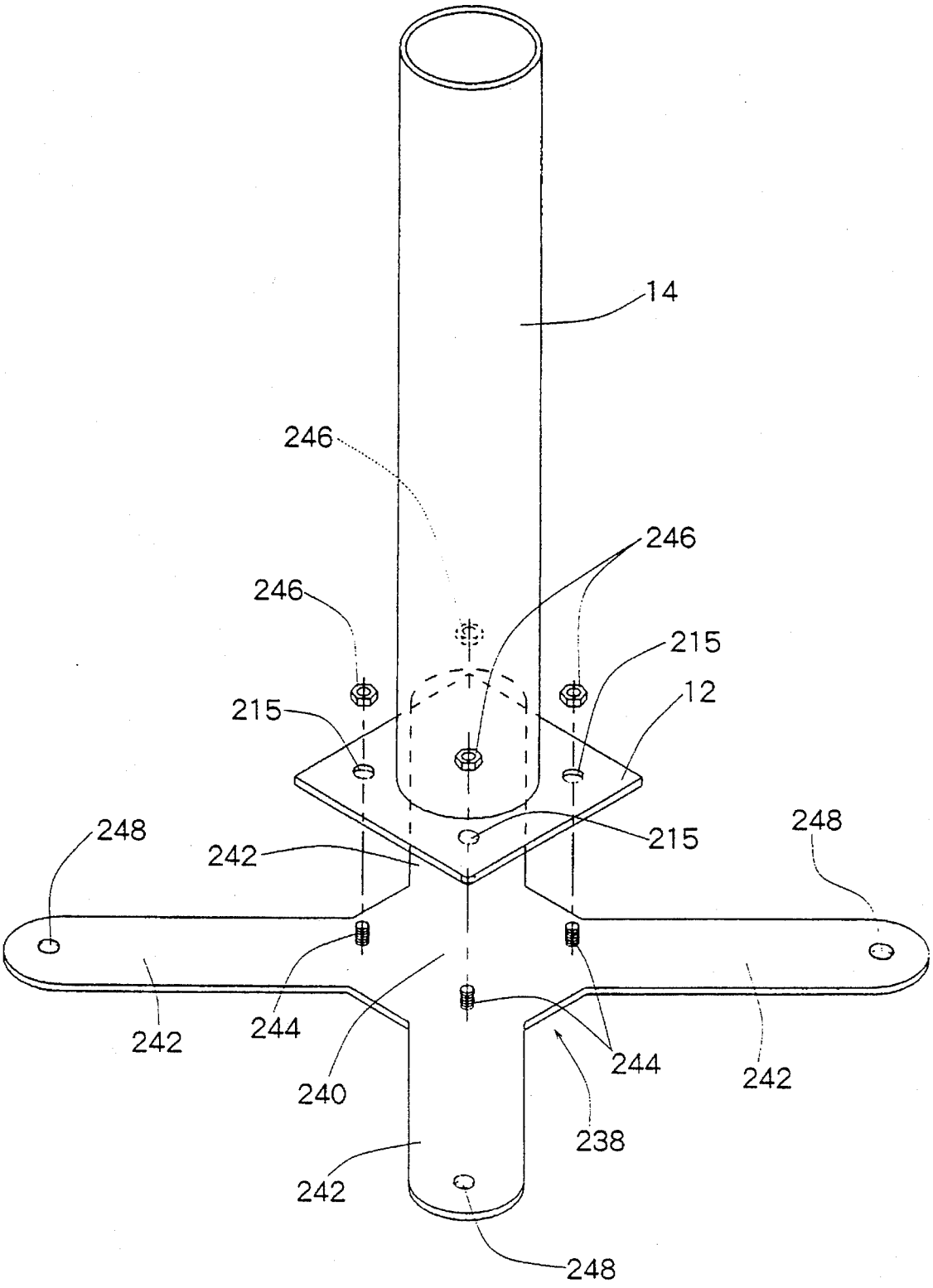
FIG. 11 is a perspective view illustrating the state where the auxiliary support member according to a further embodiment is mounted.

FIG. 11 illustrates a further auxiliary support member 238 which is constituted by a plate member and has four legs 242 extending from a base portion 240. The base portion 240 has four screws 244 erected at positions that are in match with the mounting holes 215 of the base 12. The screws 244 protrude toward the upper surface side of the base 12 through the holes 215, and nuts 246 are engaged with the screws 244, so that the auxiliary support member 238 is detachably attached to the base 12. Each leg 242 has at its end portion a hole 248 for mounting onto the mounting surface.

Figure 12:
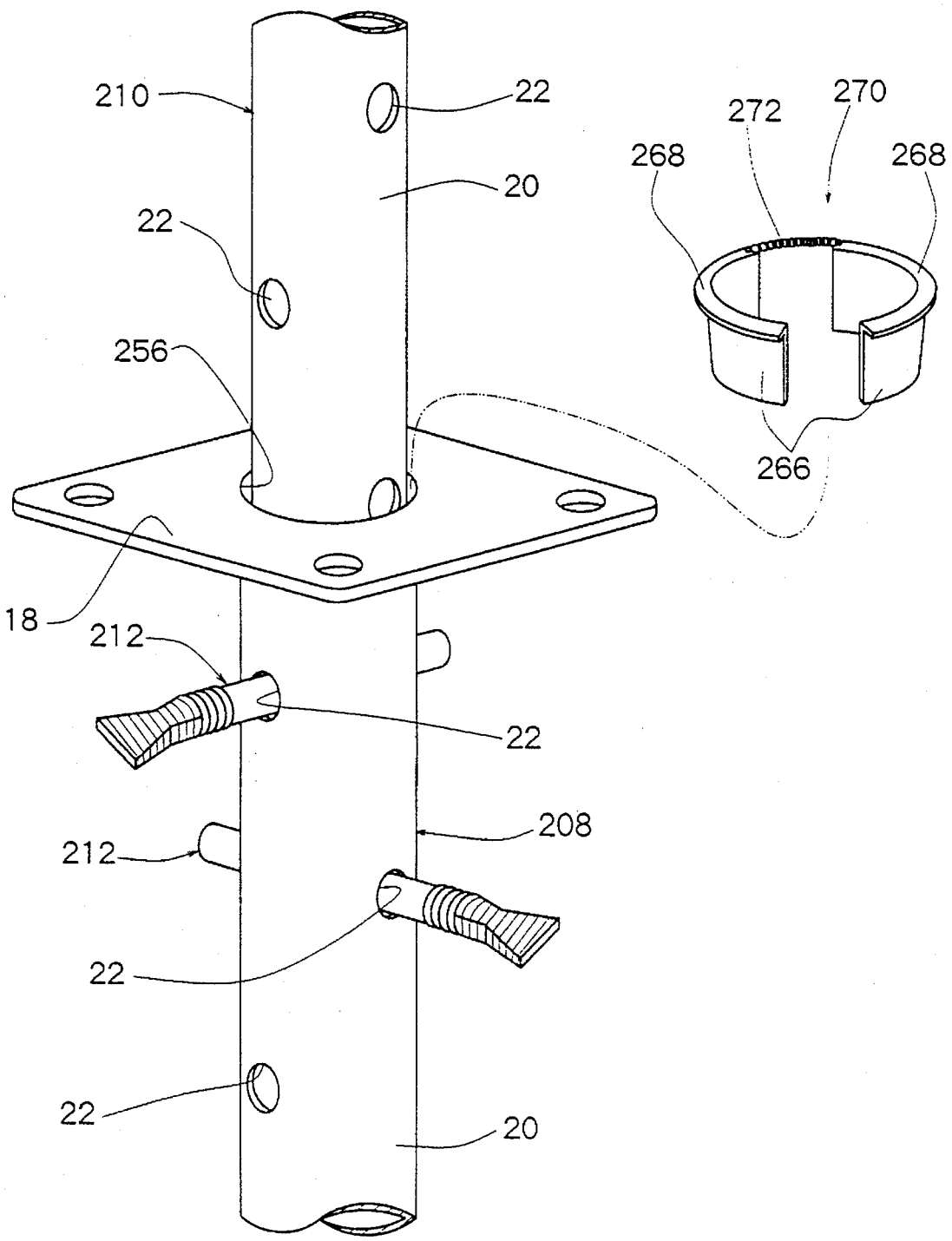
FIG. 12 is a perspective view illustrating, in a disassembled manner, a steady-rest means mounted on the supports shown in FIGS. 7 and 8.
Figure 13:
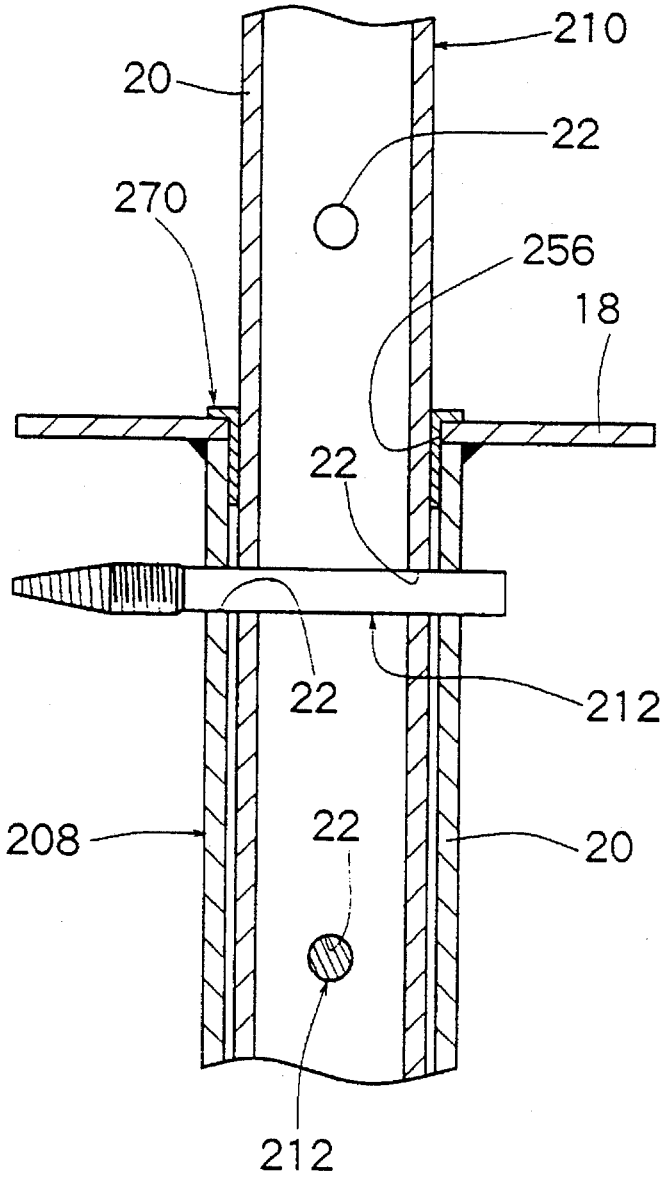
FIG. 13 is a sectional view illustrating a state where the steady-rest means shown in FIG. 12 is mounted.

With reference to FIGS. 7, 12 and 13, the support 200 is equipped with a plurality of insertion pipe means including insertion pipes 20 that will be inserted in the support pipe 14. That is, in the embodiment shown in FIG. 7, provision is made of an insertion pipe means 210 in addition to the insertion pipe means 208.

The insertion pipe means 208 and 210 have substantially the same constitution as the insertion pipe means 8 of the support 2 shown in FIG. 1 and, hence, the same portions are denoted by the same reference numerals and their description is not repeated. At the central portion of the receiving plate 18 of the insertion pipe means 208 is formed a hole 256 having an inner diameter substantially the same as the inner diameter of the insertion pipe 20.

The insertion pipe 20 (insertion pipe 20 of the lower side) of the insertion pipe means 208 has an outer diameter that can be inserted in the support pipe 14 to move in the axial direction, and the insertion pipe 20 (insertion pipe 20 of the upper side) of the insertion pipe means 210 has an outer diameter that can be inserted in the insertion pipe 20 of the lower side to move in the axial direction. At the central portion of the receiving plate 18 of the insertion pipe means 210 is formed a hole 264 having an inner diameter substantially the same as the inner diameter of the insertion pipe 20.

The support pins 212 are so constituted such that they can be removably inserted in the pairs of pin holes 22 of the insertion pipes 20. In a state where the insertion pipe 20 of the lower side is inserted in the support pipe 14, the support pin 212 has such a length that both ends thereof protrude beyond the pair of elongated holes 19 when it is inserted in a pair of pin holes 22 of the insertion pipe 20 of the lower side through the pair of elongated holes 19 of the support pipe 14. As both ends of the support pin 212 are placed on the upper end surface of the support ring means 206, the insertion pipe 20 of the lower side are supported by the support pipe means 204 maintaining the freedom of adjusting the height. In the state where the lower end side of the insertion pipe 20 of the upper side is inserted in the upper end side of the insertion pipe 20 of the lower side, the pairs of pin holes of the insertion pipe 20 of the upper side are defined for their positions to be brought into match with the pairs of pin holes 22 of the insertion pipe 20 of the lower side. In a state where the insertion pipe 20 of the upper side is inserted in the insertion pipe 20 of the lower side and the pairs of pin holes 22 of the insertion pipe 20 of the upper side in an inserted portion are brought into match with the pairs of pin holes 22 of the insertion pipe 20 of the lower side, at least two support pins 212 are removably inserted in corresponding pairs of pin holes 22 being deviated by 90°. Thus, the insertion pipe 20 of the upper side is coupled to, and supported by, the insertion pipe 20 of the lower side. As the support pins 212 are inserted in the pairs of pin holes 22 in a crossing manner, deviation of the insertion pipe 20 of the upper side is effectively prevented with respect to the insertion pipe 20 of the lower side. The supporting strength increases, too.

With reference to FIGS. 12 and 13, in a state where the insertion pipe 20 of the upper side is inserted in the insertion pipe 20 of the lower side and is supported by the support pins 212, an annular gap is formed between the outer diameter of the insertion pipe 20 of the upper side and the inner diameter of the insertion pipe 20 of the lower side and between the outer diameter of the insertion pipe 20 of the upper side and the inner diameter of the hole 256 of the receiving plate 18. In the gap is inserted (with force) wedge portions 266 of a coupling 270 that has cylindrical wedge portions 266 split into two in the axial direction and flange portions 268 that are formed at the upper ends of the wedge portions 266 to outwardly extend in the radial direction. The coupling 270 split into two is coupled together with a chain 272. With the coupling 270 being forcibly inserted in the gap, deviation of the insertion pipe 20 of the upper side is effectively prevented with respect to the insertion pipe 20 of the lower side.

Figure 8:
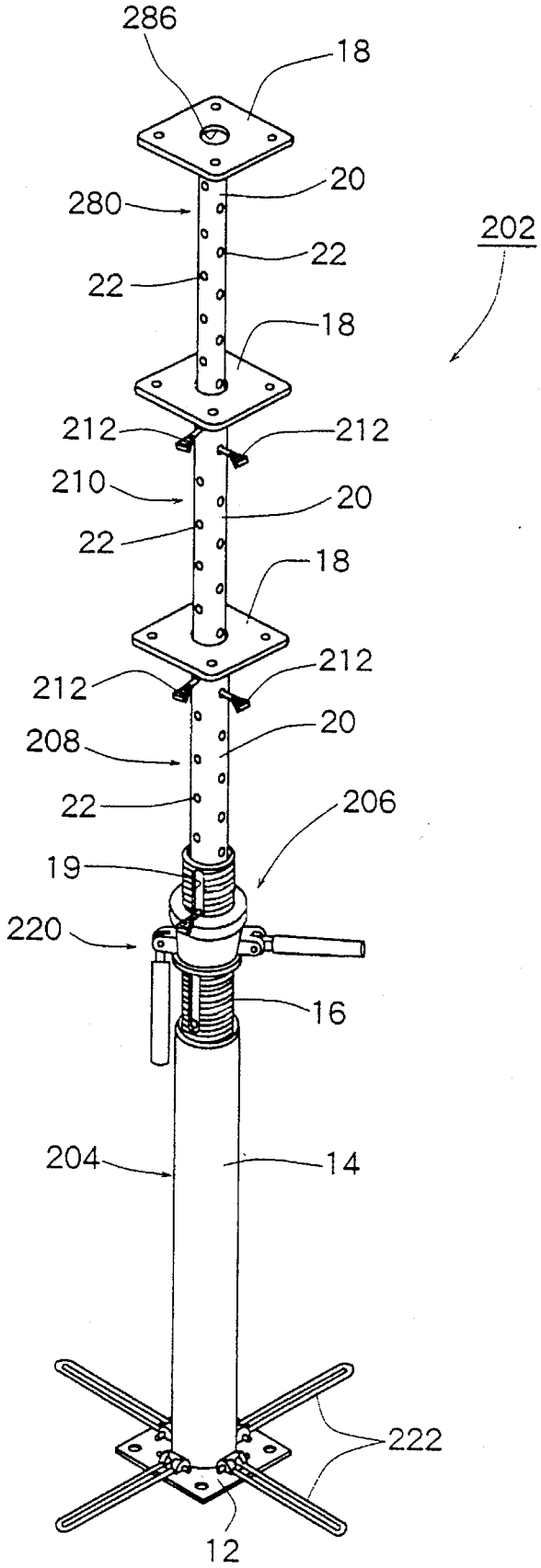
FIG. 8 is a perspective view illustrating the support improved according to a further embodiment of the present invention.

FIG. 8 illustrates the support 202 improved according to a further embodiment of the present invention, which is provided with an insertion pipe means 280 in addition to the insertion pipe means 208 and 210. In other respects, the constitution is substantially the same as the support 200 shown in FIG. 7. The insertion pipe means 280 has substantially the same constitution as the insertion pipe means 8 of the support 2 shown in FIG. 1 and, hence, the same portions are denoted by the same reference numerals and their description is not repeated. The insertion pipe 20 (uppermost insertion pipe 20) of the insertion pipe means 280 has an outer diameter that can be inserted in the insertion pipe 20 (intermediate insertion pipe 20 in FIG. 8) of the insertion pipe means 210 to move in the axial direction. At the central portion of the receiving plate 18 of the insertion pipe means 280 is formed a hole 286 having an inner diameter substantially the same as the inner diameter of the insertion pipe 20.

In a state where the lower end portion of the uppermost insertion pipe 20 is inserted in the upper end portion of the intermediate insertion pipe 20, the pairs of pin holes 22 of the uppermost insertion pipe 20 are so defined for their positions as to be in match with the pairs of pin holes 22 of the intermediate insertion pipe 20. In a state where the uppermost insertion pipe 20 is inserted in the intermediate insertion pipe 20 and the pairs of pin holes 22 of the uppermost insertion pipe 20 at the inserted portion are brought into match with the pairs of pin holes 22 of the intermediate insertion pipe 20, at least two support pins 212 are removably inserted in corresponding pairs of pin holes 22 being deviated by 90°. Thus, the uppermost insertion pipe 20 is coupled to, and is supported by, the intermediate insertion pipe 20. It is desired to also use the coupling 270 in a portion where the uppermost insertion pipe 20 and the intermediate insertion pipe 20 are connected together. As described above, a plurality of insertion pipe means are sequentially connected upwards to easily constitute a support of a desired height, yet effectively preventing the deviation and accomplishing stable support.

Figure 14:
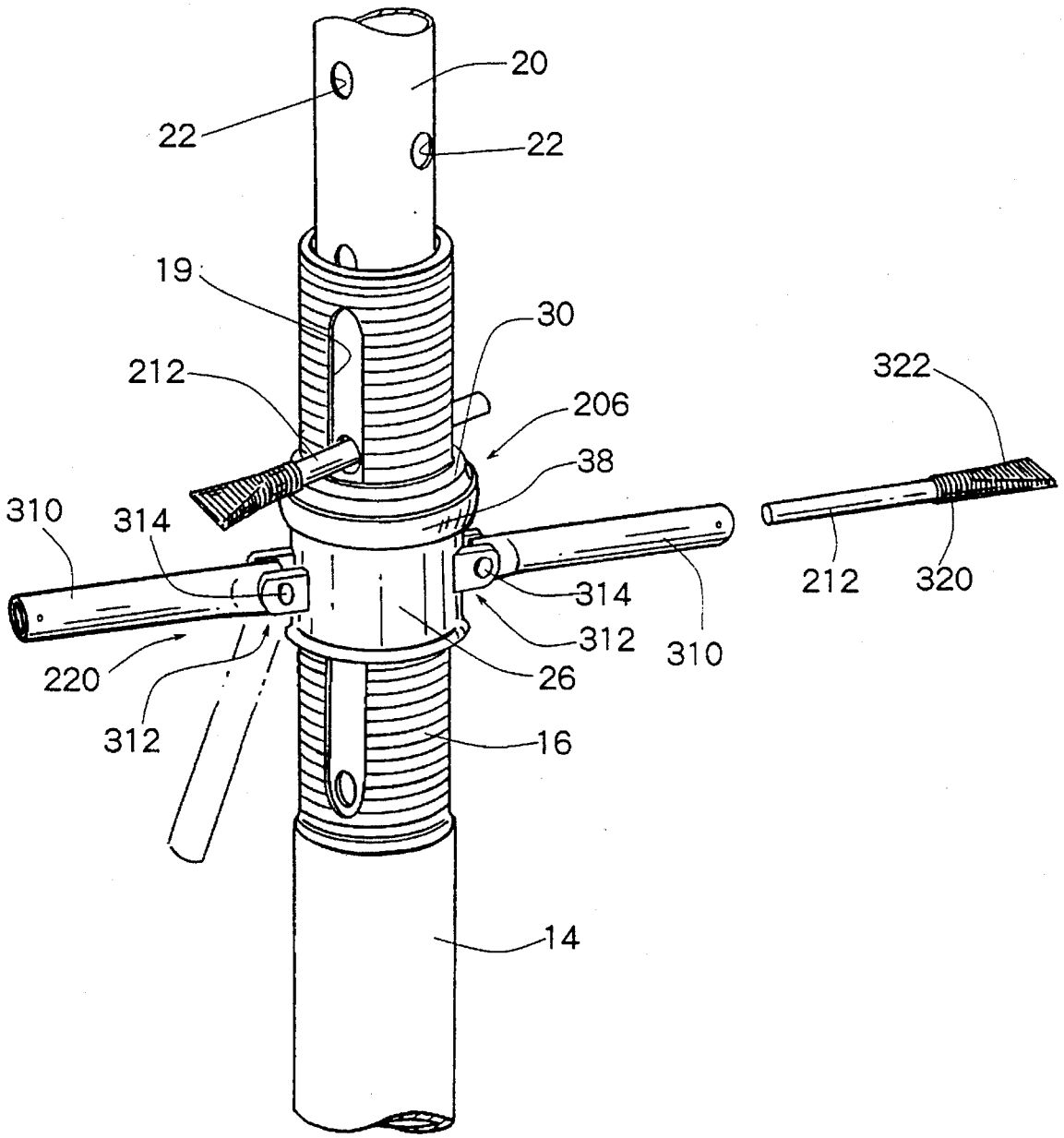
FIG. 14 is a perspective view illustrating on an enlarged scale, the vicinity of the support ring means of the support shown in FIG. 7.
Figure 15:
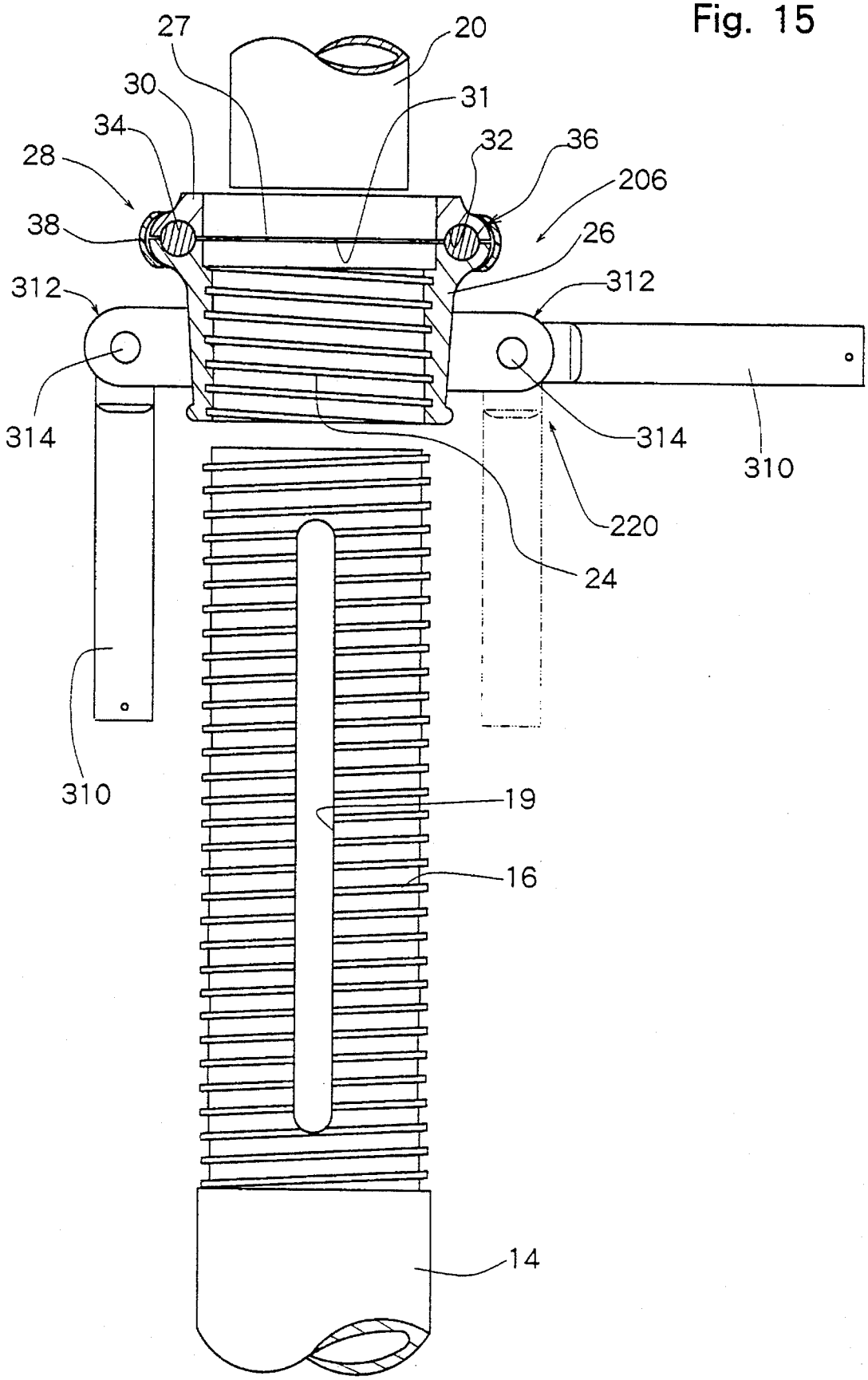
FIG. 15 is a sectional view of FIG. 14 in a disassembled manner.
Figure 16:
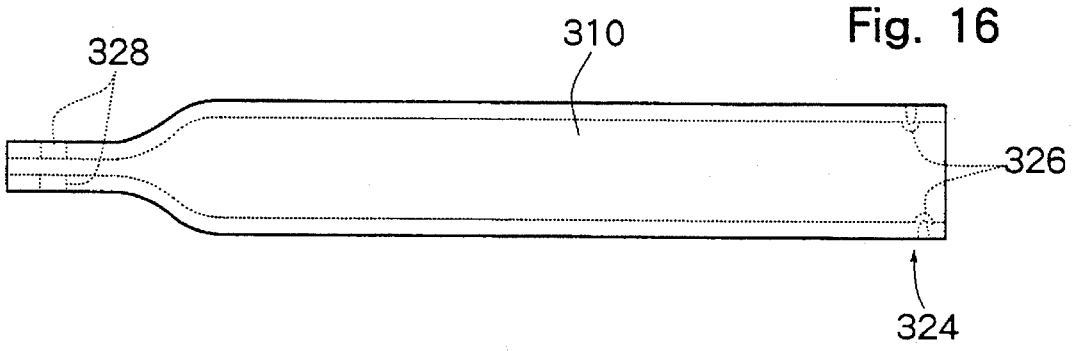
FIG. 16 is a top view of the rotary operation handle.
Figure 17:
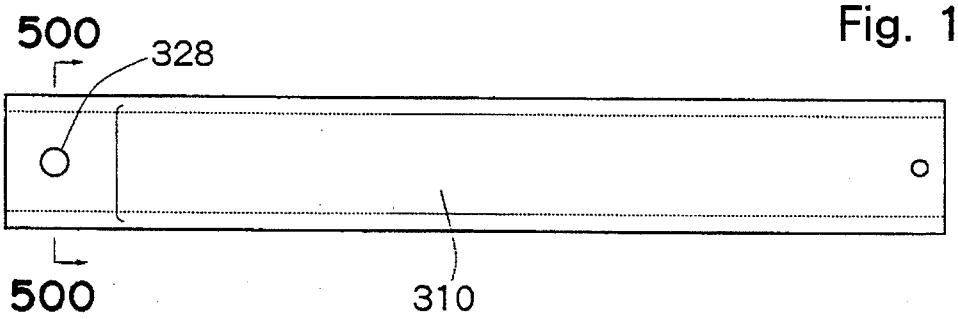
FIG. 17 is a front view of FIG. 16.

FIGS. 14 and 15 illustrate in detail the support ring means 206 provided for the support 200 shown in FIG. 7. The support ring means 206 is constituted substantially in the same manner as the support ring means 6 of the support 2 shown in FIG. 1 except the constitution of a rotary operation handle means 220. Therefore, the same portions are denoted by the same reference numerals and their description is not repeated.

With reference to FIGS. 14 and 15, a rotary operation handle means 220 is provided on the outer peripheral portion of the main support ring member 26, the rotary operation handle means 220 including a pair of rotary operation handles 310. That is, support portions 312 that are outwardly protruding in the radial direction are provided on the outer peripheral portion of the main support ring member 26 at positions separated from each other by 180°. An end of a rotary operation handle 310 is pivotally supported by each of these support portions 312 via a pin 314. The rotary operation handles 310 are allowed to pivot between a horizontal position and a vertical position. The rotary operation handles 310 are brought to horizontal positions indicated by solid lines in FIG. 14 and are turned by both hands; i.e., the main support ring member 26 can be turned with a relatively small operational force. Depending upon the direction of turn, the main support ring member 26 is moved upwards or downwards along the external thread 16 of the support pipe 14. Though the upper support ring member 30 does not turn due to a heavy load exerted on the upper end surface of the upper support ring member 30 via the support pin 212, it is allowed to easily turn the main support ring member 26 owing to the function of the upper thrust bearing means 28. Owing to a combination with the function of a pair of rotary operation handles 310, therefore, the main support ring member 26 can be turned very smoothly and easily despite a heavy load exerted thereon.

As described above, the main support ring member 26 that is provided with a pair of rotary operation handles can be turned by both hands; i.e., the rotational force is doubled compared with the conventional support ring members that are turned by one hand. Accordingly, the main support ring member 26 can be turned more lightly and smoothly even against the same load, contributing to enhancing the operation efficiency. Moreover, laborious work is reduced greatly. This further eliminates the need of hitting the rotary operation handle 310 with a hammer or the like, eliminating the occurrence of damage or breakage, or preventing the threaded portions of the support pipe 14 and of the main support ring member 26 from being broken.

In this case, the presence of the upper thrust ring member 28 makes it possible to relatively easily turn the main support ring member 26 even when only one rotary operation handle 310 is provided.

Figure 18:
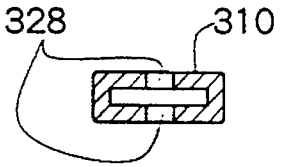
FIG. 18 is a sectional view along the line 500—500 of FIG. 17.
Figure 19:
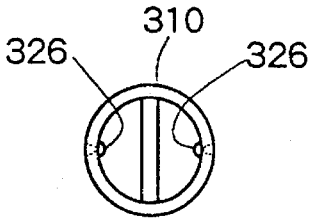
FIG. 19 is a view of when

With reference to FIGS. 14, 16 to 19, an external thread portion 320 is formed at one end of the support pin 212. At one end of the external thread portion 320 is formed a plate portion 322 having a width on both sides thereof larger than the outer diameter of the support pin 212. The plate portion 322 is formed by press after the external thread portion 320 is formed on the support pin 212. The plate portion 322 has such a shape that it broadens toward the end thereof. The external thread portion 320 has an outer diameter larger than the outer diameter of the rod portion of the support pin 212. The rotary operation handle 310 is constituted by a round pipe member and has an internal thread means 324 formed in the inner peripheral portion at the other end thereof (right end portion in FIGS. 16 and 17). The internal thread means 324 is made up of two engaging protrusions 326 that inwardly protrude from the inner peripheral portions thereof in the radial direction so as to be opposed to each other. The engaging protrusions 326 are formed at positions that are deviated relative to each other in the axial direction so as to be brought into engagement with the external thread portion 320 of the support pin 212. The internal thread means 324 may be a known internal thread as a matter of course. The rotary operation handle 310 is formed at its one end in a substantially rectangular shape in cross section as shown in FIG. 18. A hole is formed in the rectangular portion. The rotary operation handle 310 is pivotally supported at its one end, and via the pin 314, by the corresponding support portion 312 that is provided on the outer peripheral portion of the main support ring member 26. A pin 314 is inserted in the hole 328. When not in use, the support pin 212 is inserted in the rotary operation handle 310 from the end of the other side (left end side in FIG. 14) and is turned, whereby the end of the other side of the external thread portion 320 of the support pin 212 is brought into engagement (screwed) with the engaging protrusions 326 of the rotary operation handle 310. Thus, the support pin 212 is detachably held by the rotary operation handle 310. In a state where the support pin 212 is accommodated in the rotary operation handle 310, though not illustrated, the plate portion 322 only protrudes from the other end of the rotary operation handle 310. The plate portion 322 of the support pin 212 works as a knob at the time when the support pin 212 is screwed into the engaging protrusions 326 of the rotary operation handle 310 and further works as a stopper at the time when the support pin 212 is inserted in a pair of pin holes 22 of the insertion pipe 20. The above-mentioned constitution holds true even when there is provided only one rotary operation handle 310.

Figure 20:
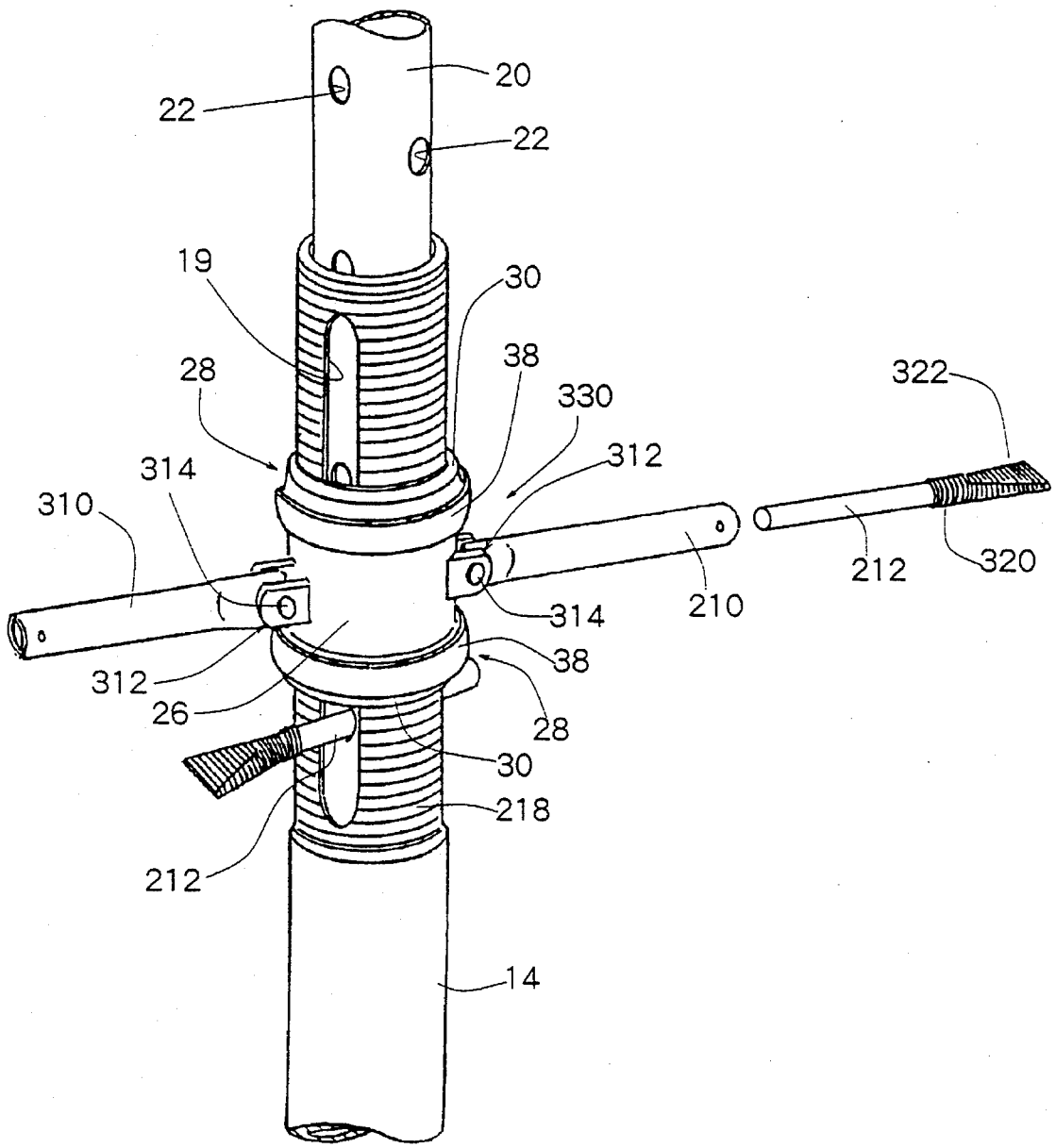
FIG. 20 is a view which partly illustrates the support equipped with the support ring means according to another embodiment and is a perspective view similar to FIG. 14.
Figure 21:
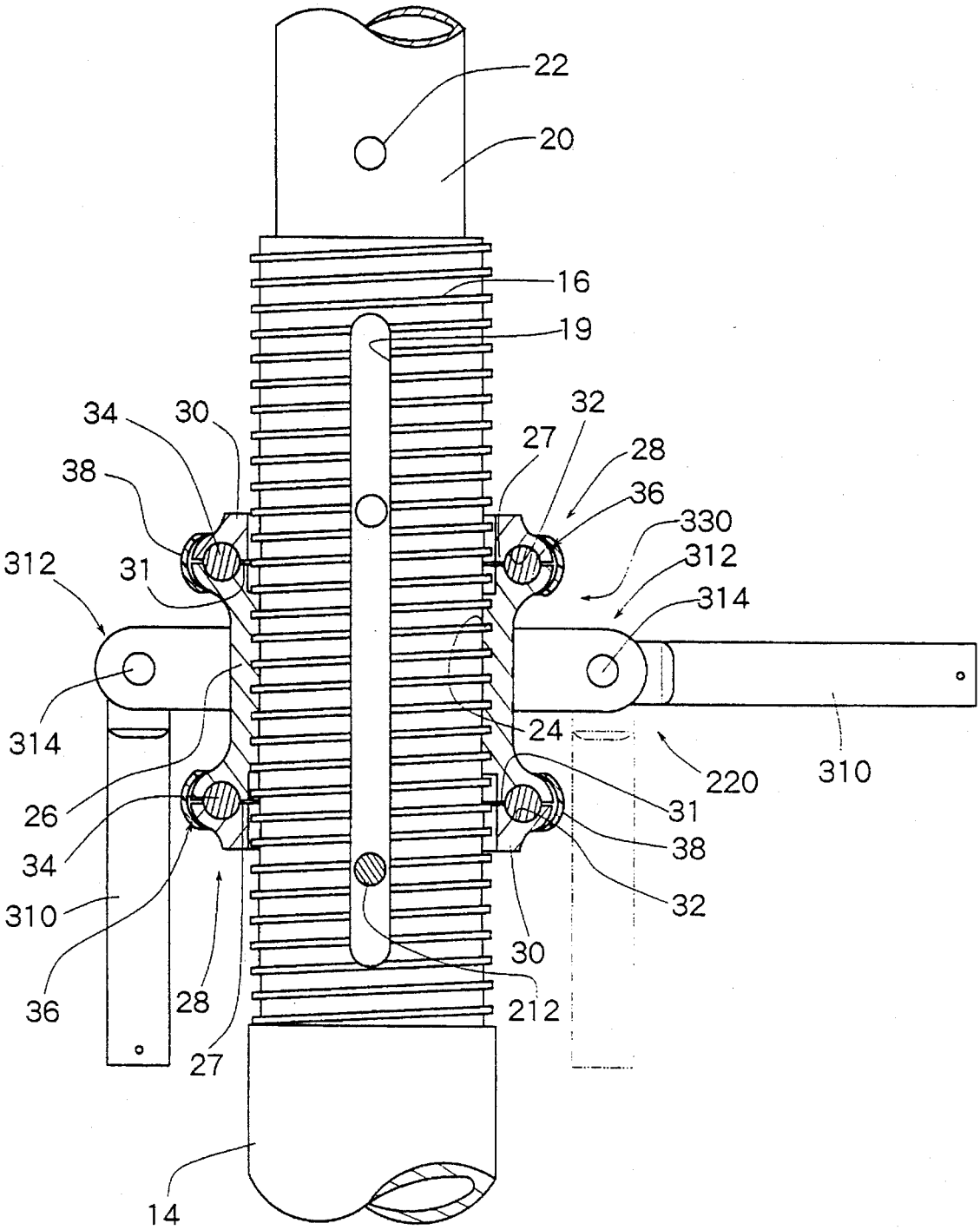
FIG. 21 is a sectional view of FIG. 20
Figure 22:
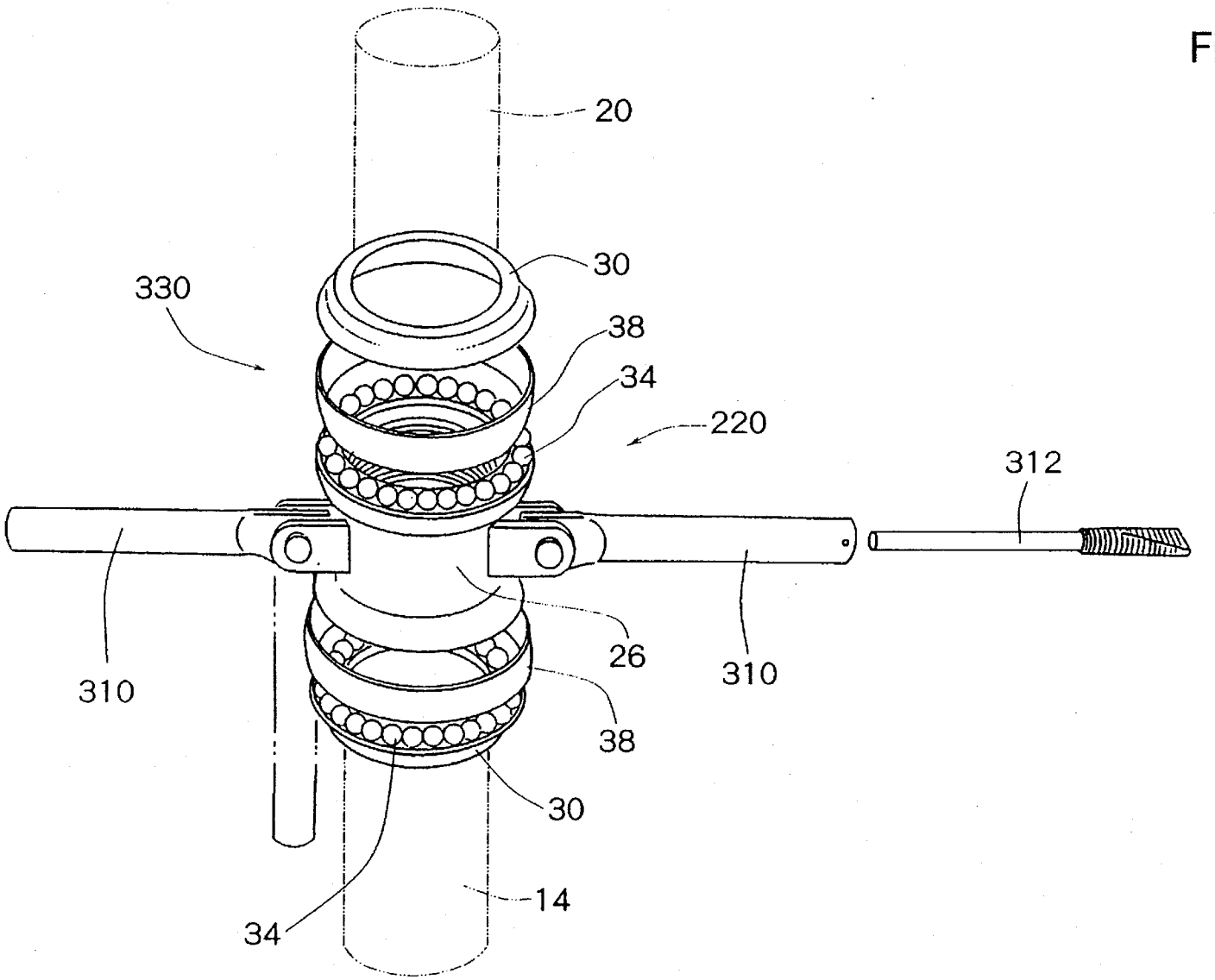
FIG. 22 is a perspective view illustrating part of the support ring means of FIG. 20 in a disassembled manner.

Described below with reference to FIGS. 20 to 22 is the support ring means according to another embodiment of the present invention. In FIGS. 20 to 22, the portions substantially the same as those of the support ring means 6 described with reference to FIGS. 4 to 6 are denoted by the same reference numerals but their description is not repeated. A support ring means 330 includes the main support ring member 26 having the internal thread 24 formed in the inner peripheral portion thereof, the upper support ring member 30 rotatably coupled to the upper end portion of the main support ring member 26 via the upper thrust bearing means 28, and a lower support ring member 30 rotatably coupled to the lower end portion of the main support ring member 26 via a lower thrust bearing means 28. A rotary operation handle means 220 is mounted on the outer peripheral portion of the main support ring member 26. That is, what makes the support ring means 330 different from the support ring means 206 (and support ring means 6) is that the lower support ring member 30 is rotatably coupled to the lower end side of the main support ring member 26 via the lower thrust bearing means 28. The upper thrust bearing means 28 and the lower thrust bearing means 28 are constituted in substantially the same manner as described with reference to FIGS. 4 to 6, and are not described here again. The support ring means 330 is provided with the lower thrust bearing means 28 because of the reason that the support can be used not only as a support member but also as a pull support member. An example of using the support will be described later. Like the support ring means 6, the support ring means 330 may be constituted not only in the structure as shown in FIGS. 20 to 22 but also in any other structure. For instance, a thrust bearing of a known constitution may be interposed between the main support ring member 26 and the upper support ring member 30 and between the main support ring member 26 and the lower support ring member 30. Or, the thrust bearing having known constitution may be fitted to the upper end portion and to the lower end portion of the main support ring member 26.

Figure 23:
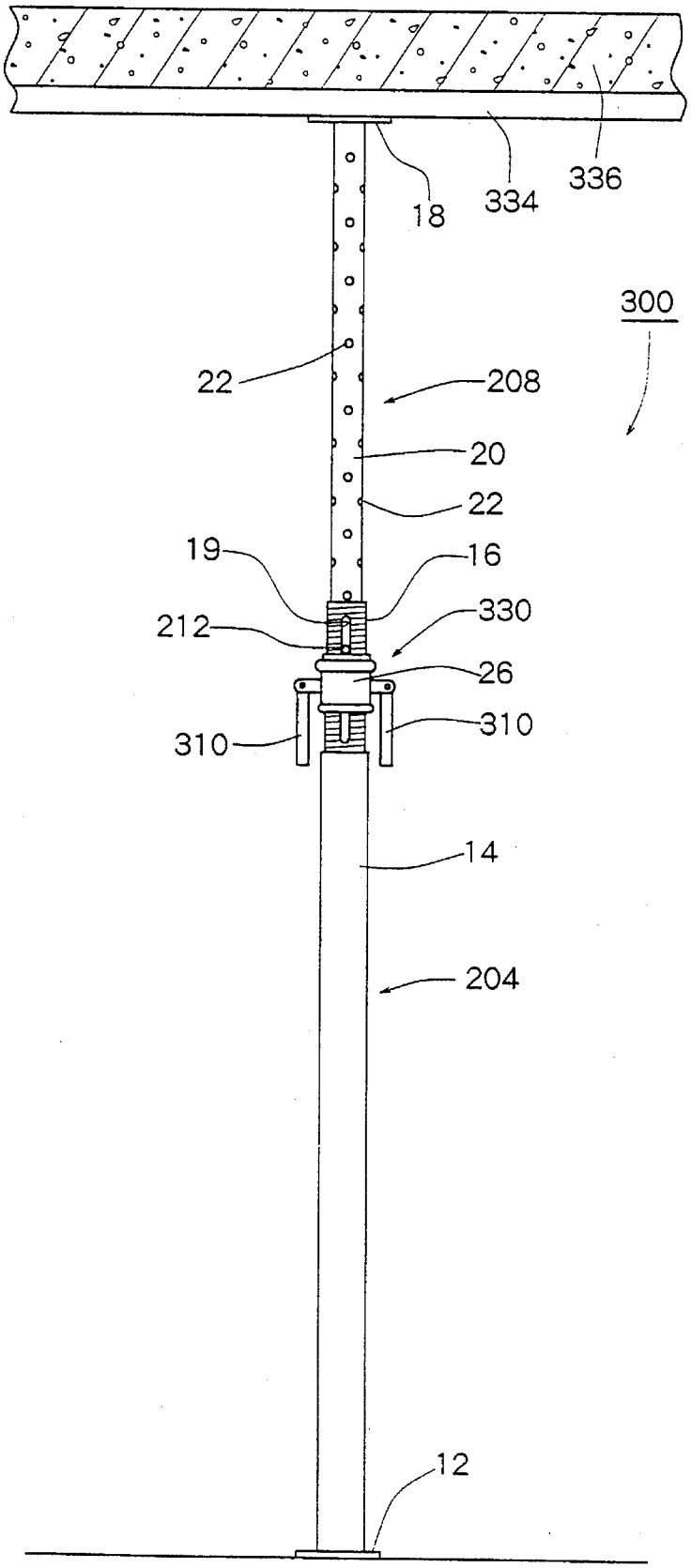
FIG. 23 is a view illustrating a state where the support equipped with the support ring means shown in FIG. 20 is used.

FIG. 23 illustrates the state of using the support 300 equipped with the support ring means 330 shown in FIG. 20, and illustrates the state where a form of the concrete slab is supported. The support 300 has the constitution same as that of the support 300 shown in FIG. 7 but in which the insertion pipe 210 is not used and the support ring means 206 is replaced by the support ring means 330. Therefore, the same portions are denoted by the same reference numerals. The insertion pipe means 208 is supported by the support pipe means 204. The height of the insertion pipe means 208 is adjusted by the support ring means 330. In FIG. 23, reference numeral 334 denotes the form(frame) and 336 denotes the concrete slab poured into the form. The support pin 212 inserted in the pair of elongated holes 19 and in a pair of pin holes 22 is located on the upper side of the support ring means 330.

Figure 24:
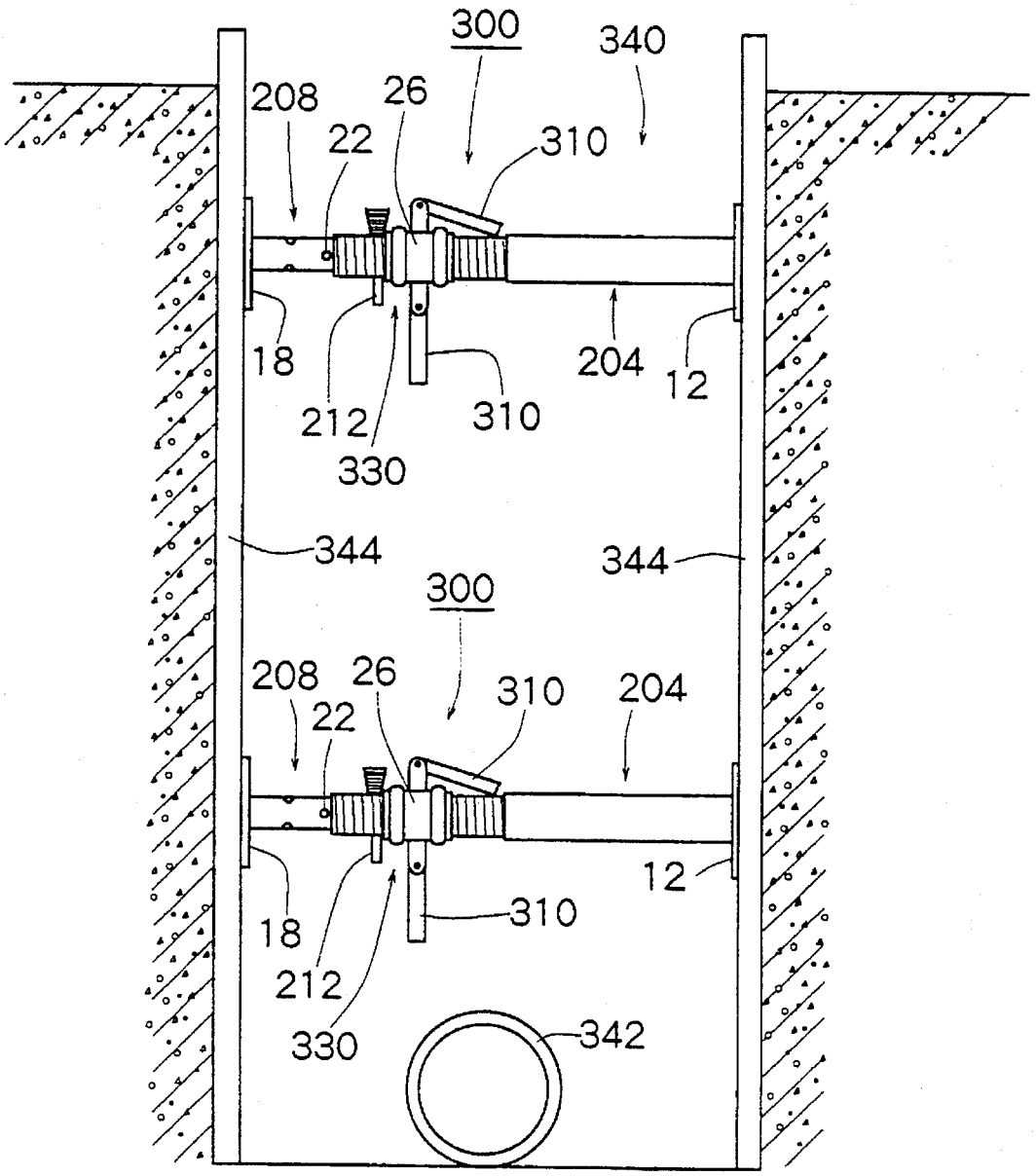
FIG. 24 is a view illustrating another state where the support equipped with the support ring means shown in FIG. 20 is used.

FIG. 24 illustrates another state of using the support 300 having constitution substantially the same as that of the support shown in FIG. 23, wherein two supports 300 are laterally positioned and are used as support members. An earthenware pipe 342 is laid on the bottom of a hole 340 excavated in the ground, and weir boards 344 are arranged on both sides of the hole 340. Two supports 300 are laterally arranged between the weir boards 344 to work as support poles (support members). The support pin 212 inserted in the pair of elongated holes 19 and in the pair of pin holes 22 is positioned on the left side of the support ring means 330. The main support ring member 26 is rotated by the rotary operation handle 310 to leftwardly extend the insertion pipe means 208 with respect to the support pipe means 204. The support 300 exerts force to the weir boards 344 in the directions to separate them away from each other, whereby the weir boards 344 are firmly held in position.

Figure 25:
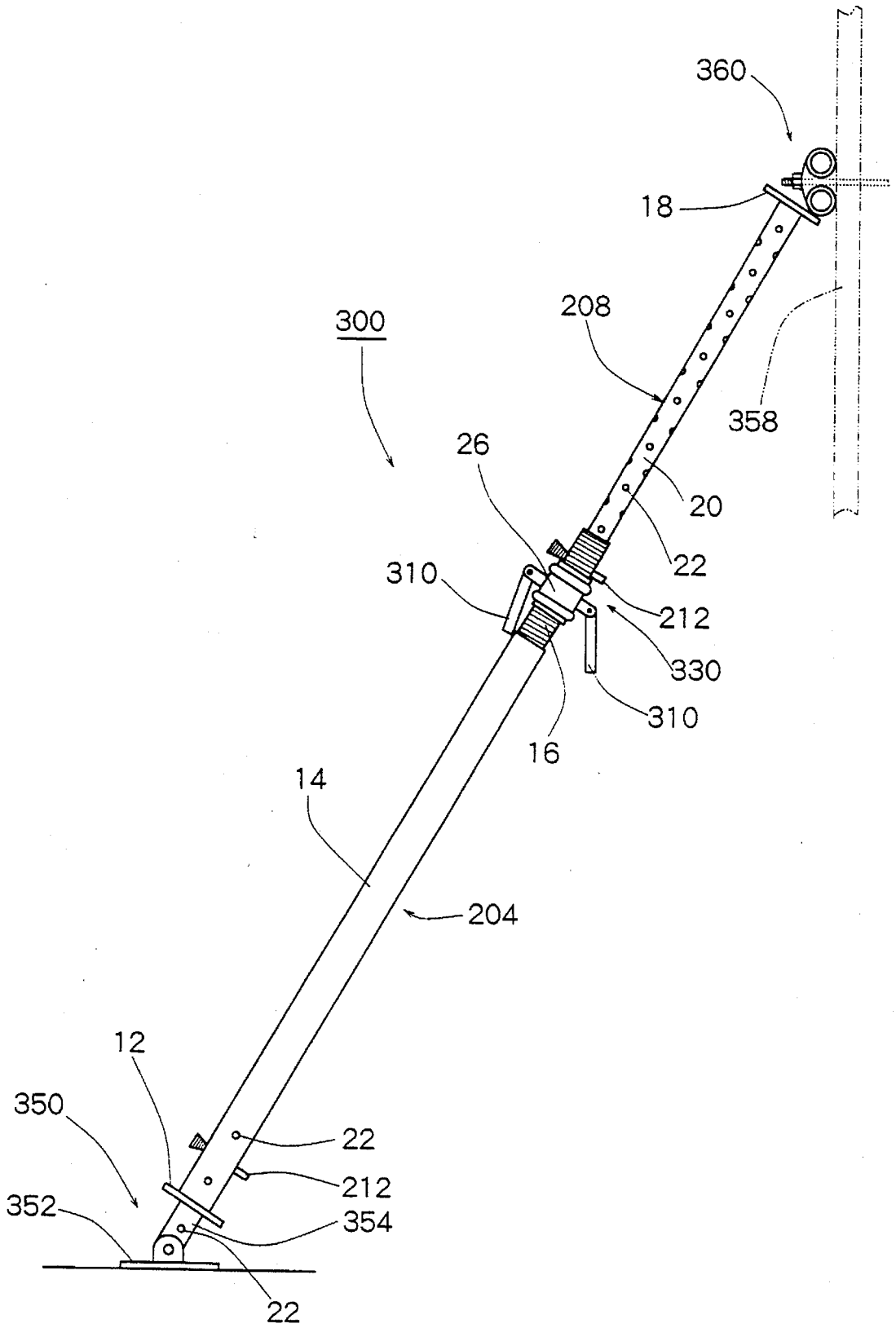
FIG. 25 is a view illustrating the state the support equipped with the support ring means shown in FIG. 20 is used according to another embodiment.
Figure 27:
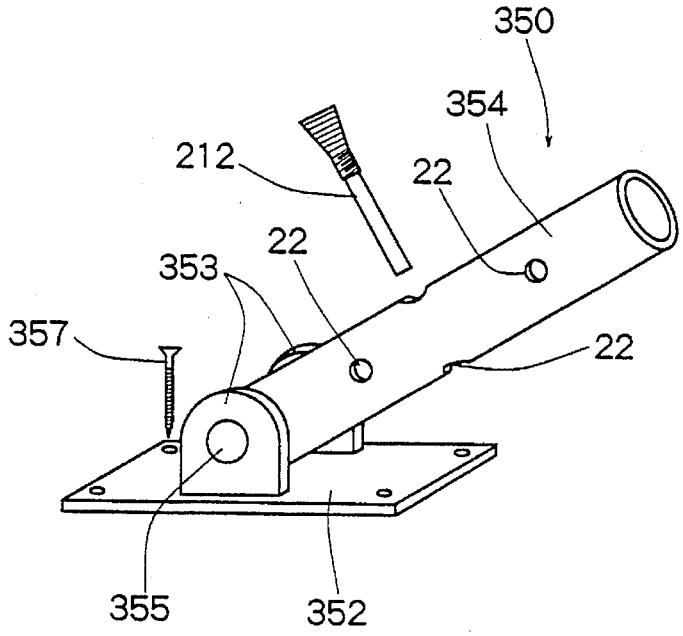
FIG. 27 is a perspective view of the lower support pipe means provided for the supports shown in FIGS. 25 and 26.
Figure 28:
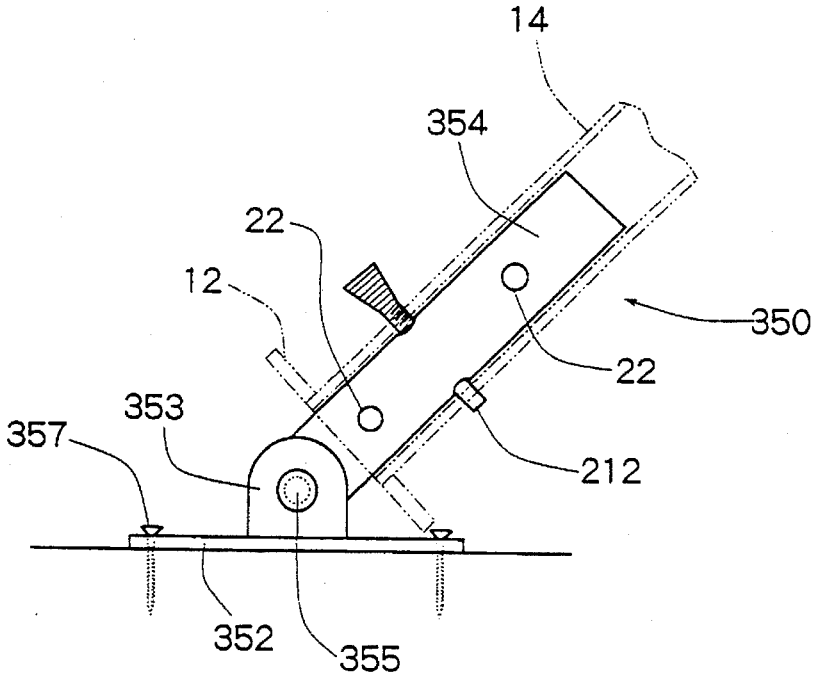
FIG. 28 is a side view illustrating the state where the lower support pipe means shown in FIG. 27 is used.

FIG. 25 illustrates the state where there is used a support which consists of the support 300 shown in FIG. 23 to which a lower support pipe means 350 is added, the support being used in an oblique manner. With reference to FIGS. 27 and 28 together with FIG. 25, the lower support pipe means 350 includes a base 352 which is so constituted that it can be detachably secured to the mounting surface, and a lower insertion pipe 354 of which the lower end is rotatably coupled to the base 352 and in which are formed plural pairs of pin holes 22 at intervals in the axial direction, the pin holes penetrating from the outer peripheral surface on one side of the insertion pipe toward the outer peripheral surface on the other side thereof. The base 352 has a pair of support portions 353 in which are formed support holes (not shown) having a common axis. In the lower end portion of the lower insertion pipe 354 are formed support holes (not shown) at right angles with the axial direction. A pin 355 is inserted in a state where the support holes of the support portions 353 are in match with the support holes of the lower insertion pipe 354, whereby the lower insertion pipe 354 is pivotally supported by the base 352. The support pipe 14 of the support pipe means 204 is so constituted that the lower end side thereof is inserted in the upper end side of the lower insertion pipe 354. The base 12 has a hole formed therein and is secured in a state where the support pipe 14 is inserted in this hole. The support pipe 14 has an inner diameter which is larger than the outer diameter of the lower insertion pipe 354. In the lower end side of the support pipe 14 are formed plural pairs of pin holes 22 at intervals in the axial direction, the pairs of pin holes 22 penetrating from the outer peripheral surface on one side thereof toward the outer peripheral surface on the other side thereof. In a state where the lower end side of the support pipe 14 is inserted in the upper end side of the lower insertion pipe 354, the pairs of pin holes 22 of the support pipe 14 are so defined for their positions as to be in match with the pairs of pin holes 22 of the lower insertion pipe 354. In a state where the lower end side of the support pipe 14 is inserted in the upper end side of the lower insertion pipe 354 and where the pairs of pin holes 22 of the support pipe 14 are in match with the pairs of pin holes 22 of the lower insertion pipe 354, at least one support pin 212 is removably inserted in one of the pairs of pin holes 22, so that the support pipe 14 is pivotally supported by the lower support pipe 354. The base 352 is detachably secured to the mounting surface by using nails 357.

In FIG. 25, the support 300 is pivotally supported on the mounting surface via the base 352. With the support 300 being tilted, the receiving plate 18 located at the uppermost portion is brought into contact with the lower side of a support member 360 of a wall molding flask 358 of concrete. The support pin 212 inserted in the pair of elongated holes 19 and in the pair of pin holes 22 is located on the upper side of the support ring means 330. The main support ring member 26 is turned by using the rotary operation handle 310, so that the insertion pipe means 208 is upwardly extended relative to the support pipe means 204. Therefore, the wall molding flask 358 is reliably held via the support member 360.

Figure 26:
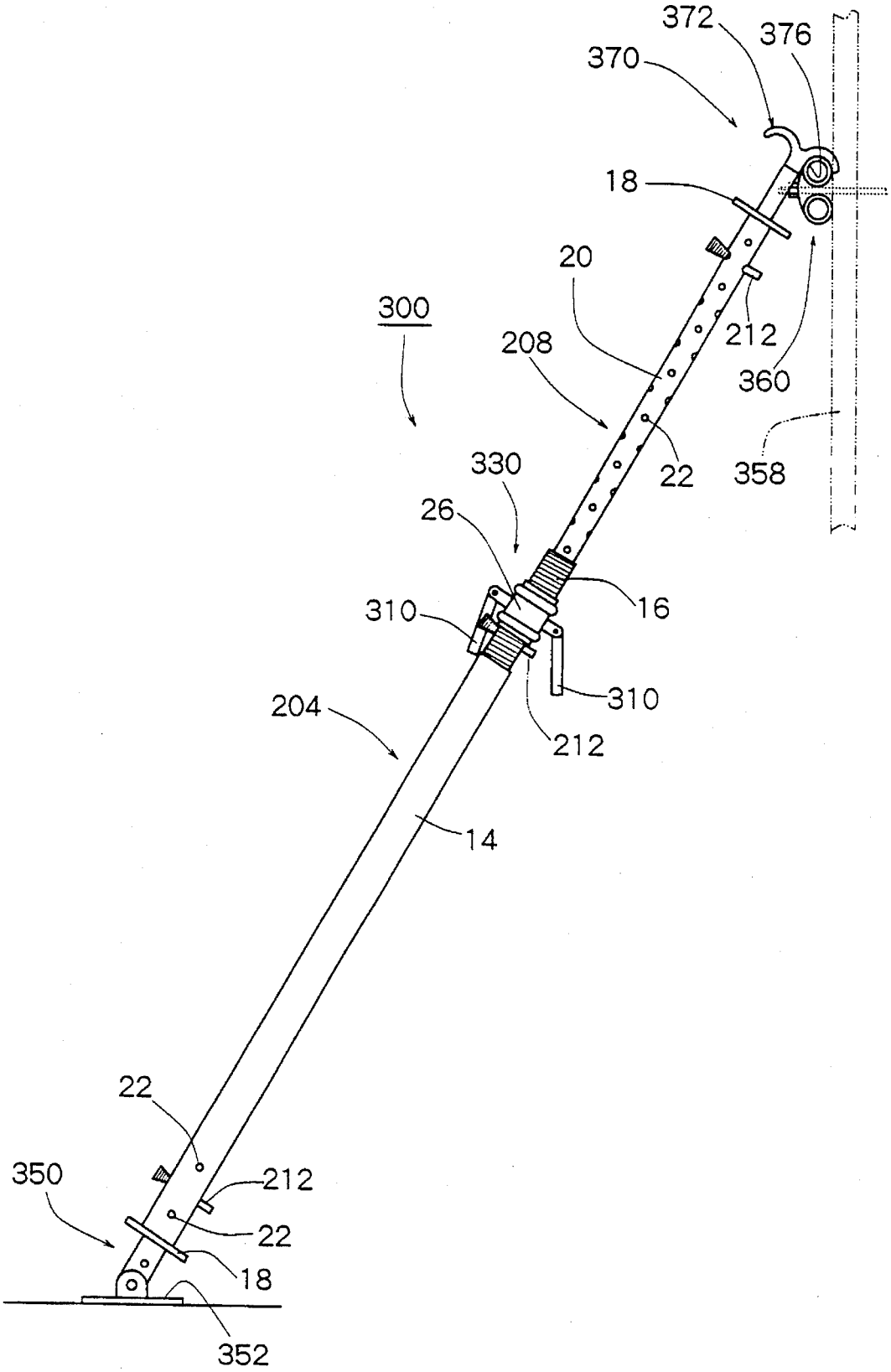
FIG. 26 is a view illustrating the state where the support equipped with the support ring means shown in FIG. 20 is used according to a further embodiment.
Figure 29:
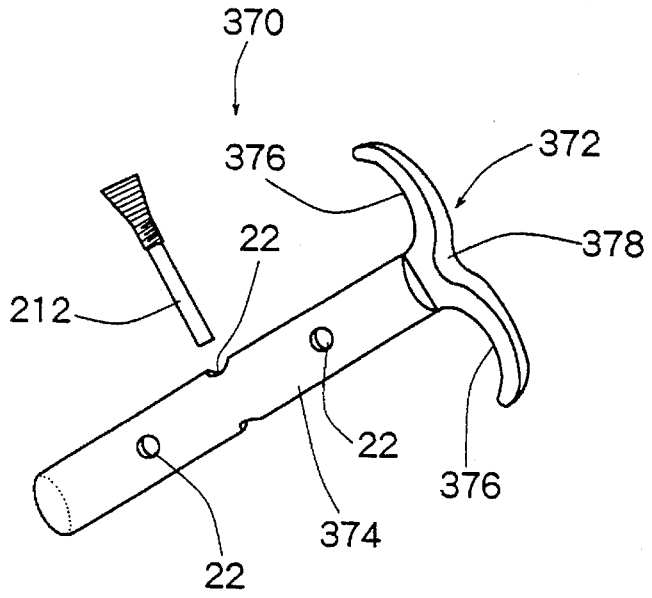
FIG. 29 is a perspective view of an insertion pipe means with a push/pull jig provided for the support of FIG. 26.
Figure 30:
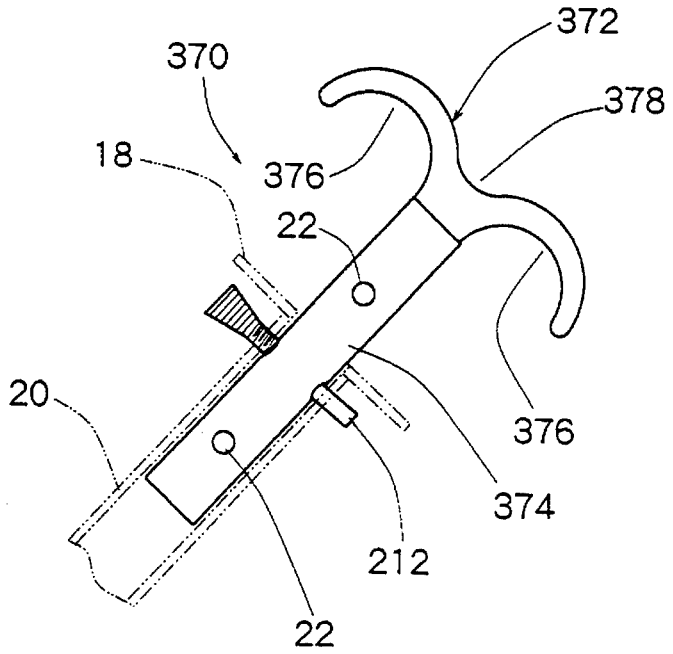
FIG. 30 is a side view illustrating a state where the insertion pipe means with a push/pull jig shown in FIG. 29 is used.

FIG. 26 illustrates the state of using the support 300 of FIG. 25 to which is added an insertion pipe means 370 equipped with a push/pull jig, i.e., illustrates the state where the support is used as an obliquely hooked pull support member. With reference to FIGS. 29 and 30 together with FIG. 26, the insertion pipe means 370 with a push/pull jig includes a push/pull jig 372 and an upper insertion pipe 374 which is secured at its upper end to the push/pull jig 372 and has plural pairs of pin holes 22 that are formed at intervals in the axial direction and penetrate from the outer peripheral surface on one side thereof to the outer peripheral surface on the other side thereof. The push/pull jig 372 has a pair of downwardly faced hook portions 376 that are outwardly extending in the radial direction and opposite to each other from a central portion where they are secured to the upper insertion pipe 374, and a recessed portion 378 formed on the upper side between the downwardly faced hook portions 376. The lower end side of the upper insertion pipe 374 is inserted in the upper end side of the insertion pipe 20 of the insertion pipe means 208. That is, the upper insertion pipe 374 has an outer diameter which is smaller than the inner diameter of the insertion pipe 20. In the upper insertion pipe 374 are further formed plural pairs of pin holes 22 that are formed at intervals in the axial direction and penetrate from the outer peripheral surface on one side thereof to the outer peripheral surface on the other side thereof. In a state where the lower end side of the upper insertion pipe 374 is inserted in the upper end side of the insertion pipe 20, the pairs of pin holes 22 of the upper insertion pipe 374 are so defined for their positions as to be in match with the pairs of pin holes 22 of the insertion pipe 20. In a state where the lower end side of the upper insertion pipe 374 is inserted in the upper end side of the insertion pipe 20 and the pairs of pin holes 22 of the upper insertion pipe 374 are brought into match with the pairs of pin holes 22 of the insertion pipe 20, at least one support pin 212 is removably inserted in a pair of pin holes 22, so that the insertion pipe means 370 equipped with the push/pull jig is supported by the insertion pipe means 208.

With the support 300 being tilted, one of the downwardly facing hook portions 376 of the push/pull jig 372 located at the uppermost portion is hooked to the upper side of a support member 360 of the wall form 358 of concrete. Here, attention should be given to the fact that the support pin 212 inserted in the pair of elongated holes 19 and in the pair of pin holes 22 is located on the lower side of the support ring means 330. In this state, the main support ring member 26 is turned by using the rotary operation handle 310, so that the insertion pipe means 208 is downwardly contracted relative to the support pipe means 204. Then, the support member 360 is pulled by the push/pull jig 372 obliquely and downwardly. Thus, the wall form 358 is reliably held via the support member 360 (well-balanced support is accomplished if the other wall form arranged via a separator that is not shown is similarly supported). It will be understood that the support 300 according to this embodiment is effectively utilized as a pull support member.

Figure 31:
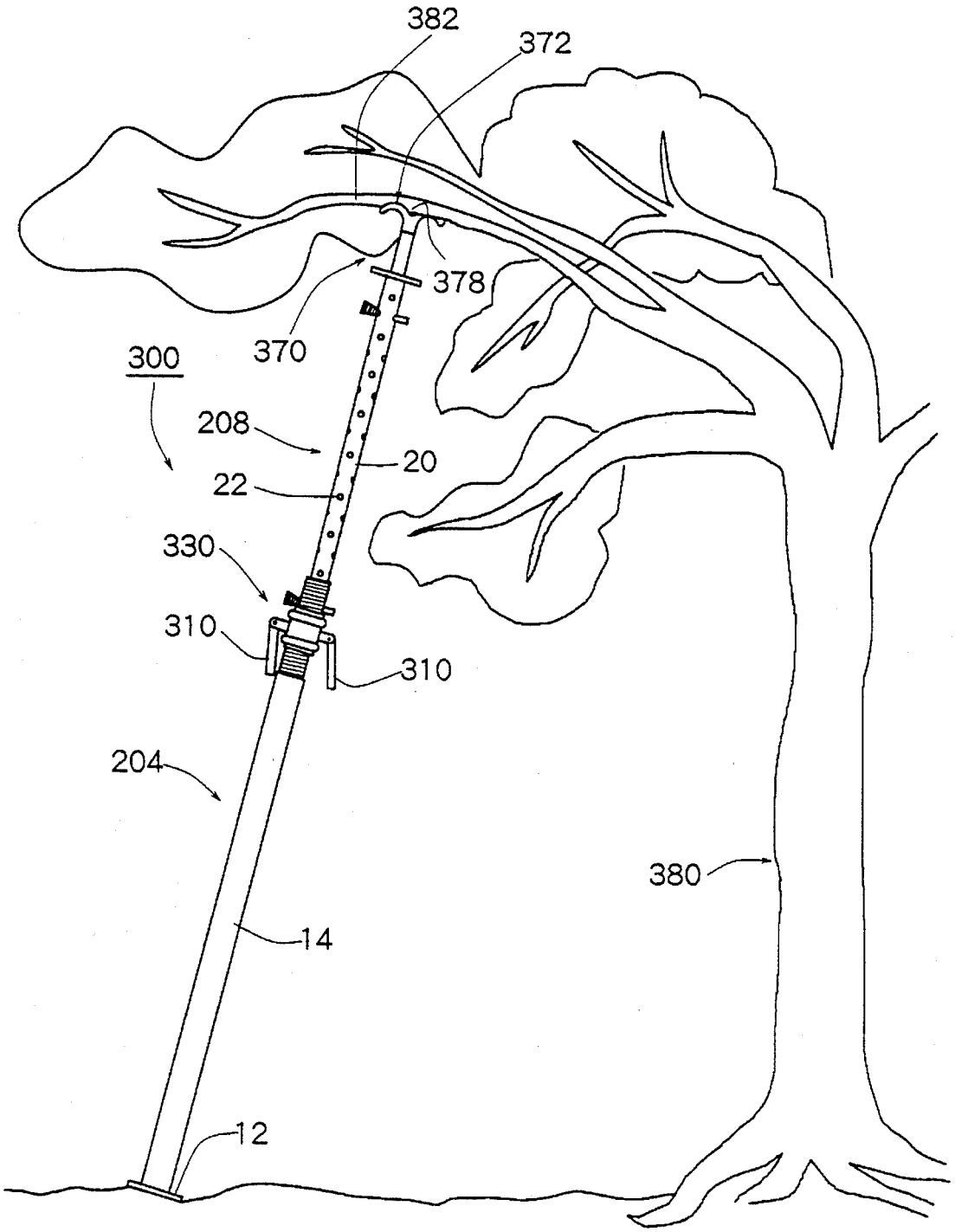
FIG. 31 is a view illustrating the state where the support equipped with the insertion pipe means having push/pull jig shown in FIG. 29 is used.
Figure 32:
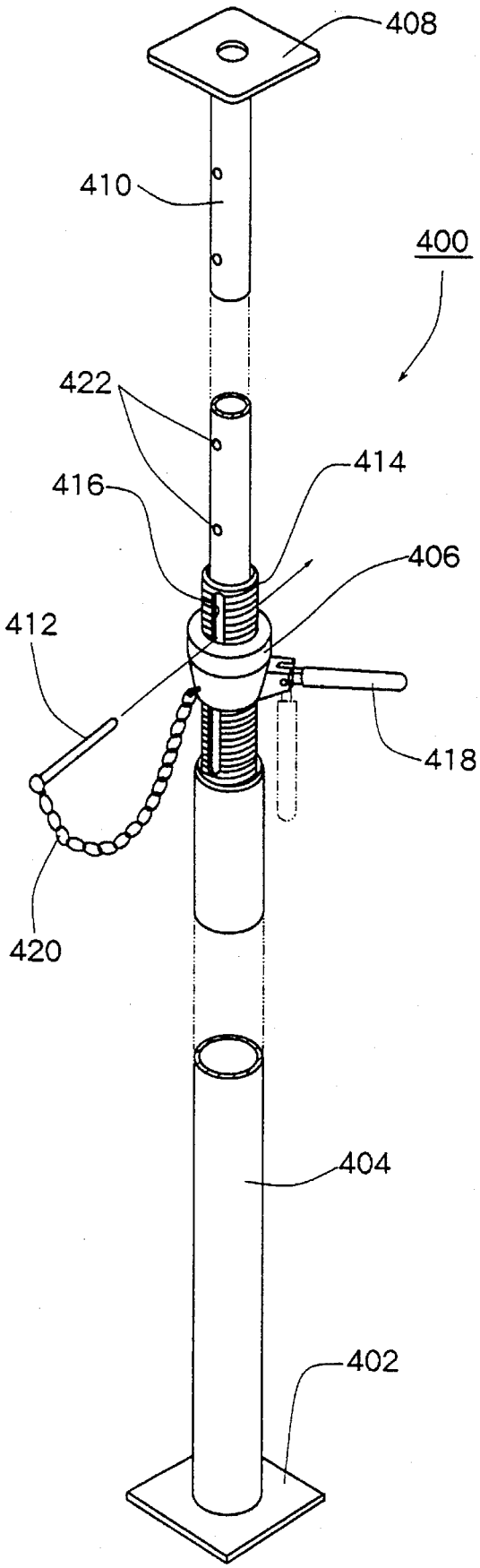
FIG. 32 is a perspective view which schematically illustrates a conventional support in a disassembled manner.
Figure 33:
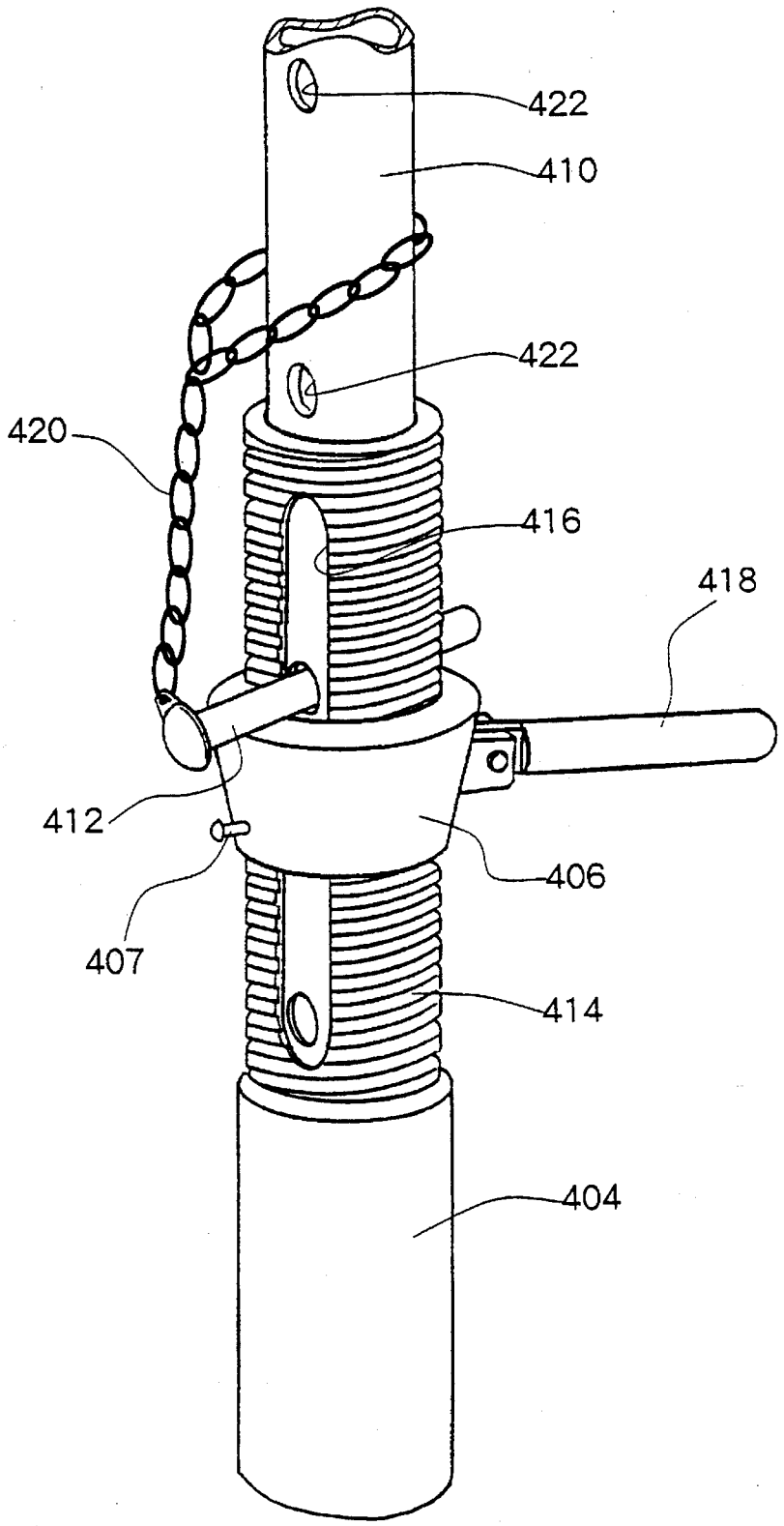
FIG. 33 is a perspective view illustrating a major portion of the support of FIG. 32 on an enlarged scale.

FIG. 31 illustrates a state of using the support 300 of FIG. 23 to which is added the insertion pipe means 370 equipped with the push/pull jig, i.e., illustrate a state where the support is used as an obliquely hooked support member. With the support 300 being tilted, the recessed portion 378 of the push/pull jig 372 located at the uppermost portion is fitted to the lower portion of a branch 382 of a fruit-tree. The support pin 212 inserted in the pair of elongated holes 19 and in the pair of pin holes 22 is located on the upper side of the support ring means 330. In this state, the main support ring member 26 is turned by using the rotary operation handle 310, so that the insertion pipe means 208 is upwardly extended relative to the support pipe means 204. This makes it possible to reliably support from the lower direction a branch 382 that tends to be downwardly deflected by a number of ripened fruit. In this case, the support 300 shown in FIG. 26 may be used as a matter of course.

Though the invention was described above in detail by way of embodiments, it should be noted that the present invention is in no way limited to the above embodiments only but can be varied or modified in a variety of ways without departing from the scope of the invention.

The following principal effects are obtained by the support of the present invention that was described above by way of embodiments.

(1) The support ring means can be easily rotated even in a state where a heavy load is exerted. As a result, the operation efficiency is improved and laborious work is greatly reduced. The rotary operation handle needs no longer be hit by a hammer or the like, and is not damaged or broken and, besides, the threaded portions of the support pipe and of the support ring means are not damaged, either.

(2) The support can be utilized as a support member or as a pull support member in addition to being used as a support member, offering a variety of functions.

(3) The support pin is reliably prevented from being lost without impairing the operation for turning the support ring means.

(4) Even when the insertion pipe means are connected in a plural number, the insertion portions are prevented from being deviated, and the load can be supported at a relatively high position. Moreover, the strength of support increases.

What I claim is:

1. A support comprising:

a support pipe means having a lower end and defining an external thread and a pair of elongated holes at an upper end portion thereof, the elongated holes penetrating from a first outer peripheral surface of the support pipe means on one side thereof to a second outer peripheral surface of the support pipe means on another side thereof and extending in an axial direction of the support pipe means;

a support ring means including a main support ring member having an upper end, a lower end, an outer peripheral portion, and an inner peripheral portion with an internal thread formed therein, an upper support ring member having a lower end, upper thrust bearing means rotatably coupling the upper end of the main support ring member to the upper support ring member, the upper thrust bearing means including an annular groove formed between a surface of the lower end of the upper support ring member and a surface of the upper end of the main support ring member when the lower end surface of the upper support ring member and the upper end surface of the main support ring member are opposed to each other with a gap therebetween, plurality of balls rotatably inserted in the annular groove, an annular protruded portion that is continuously formed between an outer peripheral surface of the lower end of the upper support ring member and an outer peripheral surface of the upper end of the main support ring member, and an annular retainer member slidably fitted to a circumference of the annular protruded portion so as to cover the gap, the internal thread of the main support ring member being engageable with the external thread of the support pipe means such that the support ring means is movable in the axial direction;

a rotary operation handle fitted to the outer peripheral portion of the main support ring member;

an insertion pipe means having a lower end portion movably insertable into the support pipe means and defining plural pairs of pin holes at intervals in the axial direction of the insertion pipe means which penetrate from a first outer peripheral surface of the insertion pipe means at one side thereof to a second outer peripheral surface of the insertion pipe on another side thereof; and a support pin removably insertable into each of the pairs of pin holes, the support pin having such a length that both ends thereof protrude beyond the pair of elongated holes when the support pin is inserted in one of the pairs of pin holes of the insertion pipe means through the pair of elongated holes formed in the support pipe means while the insertion pipe means is inserted in the support pipe means, wherein the insertion pipe means can be supported by the support pipe means in a manner such that a height of the insertion pipe means can be adjusted when both ends of the support pin are placed on an upper end surface of the support ring means.

2. A support according to claim 1, wherein the rotary operation handle means of the support ring means includes a pair of rotary operation handles, each of the handles being pivotally supported at one end by the outer peripheral portion of the main support ring member, the handles being located at positions separated from each other by 180°.

3. A support according to claim 1, further including:

a lower support pipe means having a base which is detachably securable to a mounting surface, and a lower insertion pipe having an upper end portion and a lower end portion and being pivotally coupled at the lower end portion to the base, the lower insertion pipe defining plural pairs of pin holes at intervals in an axial direction of the lower insertion pipe which penetrate from a first outer peripheral surface of the lower insertion pipe on one side thereof to a second outer peripheral surface of the lower insertion pipe on another side thereof, and a lower support pin, wherein the lower end of the support pipe means fits over the upper end portion of the lower insertion pipe and defines plural pairs of pin holes at intervals in the axial direction of the support pipe means such that the pin holes penetrate from the first outer peripheral surface of the support pipe means to the second outer peripheral surface of the support pipe means, the pairs of pin holes of the lower end of the support pipe means being positioned so as to be matchable with the pairs of pin holes of the lower insertion pipe when the lower end portion of the support pipe means is fit over the upper end portion of the lower insertion pipe, and wherein the lower support pin is removably insertable in one of the pairs of the pin holes of the lower insertion pipe when the lower end of the support pipe means is fit over the upper end portion of the lower insertion pipe and the pairs of the pin holes of the lower end of the support pipe means are matched with the pairs of pin holes of the lower insertion pipe, so that the support pipe means is supported by the lower pipe means.

4. A support according to claim 1, further including a base provided on the lower end of the support pipe means and mountable on a mounting surface, the base including a plate member of a square shape, and auxiliary support members provided at four places on the base, each of the auxiliary support members being pivotally mounted to the base at an end portion on one side of the auxiliary support member and being selectively movable between a use position where the auxiliary support member extends outwardly substantially horizontally and a non-use position where the auxiliary support member is folded so as to extend along the support pipe means.

5. A support according to claim 1, further including a base provided on the lower end of the support pipe means and mountable on a mounting surface, the base including a plate member of a square shape, and auxiliary support members having legs extending into four directions detachably fitted to a lower surface of the base.

6. A support according to claim 1, further includes a lower support ring member, and a lower thrust bearing means rotatably coupling the lower support ring member to the lower end of the main support ring member.

7. A support according to claim 6, wherein the lower thrust bearing means includes a second annular groove formed between a surface of an upper end of the lower support ring member and a surface of the lower end of the main support ring member when the upper end surface of the lower support ring member and the lower end surface of the main support ring member are opposed to each other with a second gap therebetween, a second plurality of balls rotatably inserted in the second annular groove, a second annular protruded portion that is continuously formed between an outer peripheral surface of the upper end of the lower support ring member and an outer peripheral surface of the lower end of the main support ring member, and a second annular retainer member that is slidably fitted to the circumference of the second annular protruded portion so as to cover the second gap.

8. A support according to claim 6, further including an upper insertion pipe means having a lower end portion and an upper end portion, the lower end portion of the upper insertion pipe means being insertable into an upper end portion of the insertion pipe means and defining plural pairs of pin holes at intervals in an axial direction of the upper insertion pipe means which penetrate from a first outer peripheral surface of the upper insertion pipe means on one side thereof to a second outer peripheral surface of the upper insertion pipe means on another side thereof, the pairs of pin holes of the upper insertion pipe means being positioned so as to be matchable with the pairs of pin holes of the insertion pipe means when the lower end portion of the upper insertion pipe means is inserted in the upper end portion of the insertion pipe means, and a push/pull jig having a central portion secured to the upper end portion of the upper insertion pipe means, a pair of downwardly faced hook portions that outwardly extend from the central portion in a radial direction of the upper insertion pipe means opposite each other, and a recessed portion on an upper side of the push/pull jig between the downwardly faced hook portions, and an upper support pin removably insertable in one of the pairs of the pin holes of the upper insertion pipe means when the lower end portion of the upper insertion pipe means is inserted in the upper end portion of the insertion pipe means and the pairs of the pin holes of the upper insertion pipe means are matched with the pairs of the pin holes of the insertion pipe means, so that the upper insertion pipe means equipped with the push/pull jig is supported by the insertion pipe means.

9. A support comprising a support pipe means defining an external thread and a pair of elongated holes at an upper end portion thereof, the elongated holes penetrating from a first outer peripheral surface of the support pipe means on one side thereof to a second outer peripheral surface of the support pipe means on another side thereof and extending in an axial direction of the support pipe means;

a support ring means having an internal thread formed therein, the internal thread of the support ring means being engageable with the external thread of the support pipe means such that the support ring means is movable in the axial direction;

a rotary operation handle means fitted to the support ring means;

a primary insertion pipe means having a lower end portion movably insertable into the support pipe means and defining plural pairs of pin holes at intervals in the axial direction of the primary insertion pipe means which penetrate from a first outer peripheral surface of the primary insertion pipe means on one side thereof to a second out peripheral surface of the primary insertion pipe means on another side thereof;

one or more secondary insertion pipe means, each of the secondary insertion pipe means defining plural pairs of pin holes intervals in an axial direction of the secondary insertion pipe means which penetrate from a first outer peripheral surface of the secondary pipe means on one side thereof to a second outer peripheral surface of the secondary pipe means on another side thereof, each of the secondary insertion pipe means being formed so that a lower end portion of the secondary insertion pipe means is insertable into an upper end portion of another insertion pipe means so as to form an upper secondary insertion pipe means and an adjacent lower insertion pipe means, the pairs of pin holes of each upper secondary insertion pipe means being positioned so as to be matchable with the pairs of pin holes of the adjacent lower insertion pipe means, axes of the pairs of pin holes formed in each of the secondary insertion pipe means being deviated by 90° relative to each other in a circumferential direction of the secondary insertion pipe means;

each of the insertion pipe means including an insertion pipe and a receiving plate secured to an upper end of the insertion pipe, the receiving plate defining a hole at a central portion thereof and having an inner diameter substantially the same as the inner diameter of the insertion pipe, such that an annular gap is formed between an outer diameter of the insertion pipe of each upper secondary insertion pipe means and an inner diameter of the insertion pipe of the adjacent lower insertion pipe means and between an outer diameter of the insertion pipe of each upper secondary insertion pipe means and an inner diameter of the hole of the receiving plate of the lower insertion pipe means, when the lower end portion of the upper secondary section pipe means is inserted into the upper end portion of the adjacent lower insertion pipe means;

a plurality of couplings, each coupling having a cylindrical wedge split into two portions in an axial direction of the coupling, and flange portions formed at the upper ends of the wedge portions so as to outwardly extend in a radial direction of the coupling, each coupling being insertable into at least one of the annular gap;

an upper support pin removably insertable into each of the pairs of pin holes of the primary insertion pipe means, the support pin having such a length that both ends thereof protrude beyond the pair of elongated holes when the support pin is inserted in one of the pairs of pin holes of the primary insertion pipe means through the pair of elongated holes formed in the support pipe means while the primary insertion pipe means is inserted in the support pipe means, wherein the primary insertion pipe means can be supported by the support pipe means in a manner such that a height of the primary insertion pipe means can be adjusted when both ends of the support pin are placed on an upper end surface of the support ring means; and at least two lower support pins removably insertable in corresponding pairs of pin holes of an upper secondary insertion means and an adjacent lower insertion pipe means when an upper secondary insertion pipe means is inserted in a lower insertion pipe means and the pairs of pin holes of the upper secondary insertion pipe means are matched with the pairs of pin holes of the lower insertion pipe means, such that the upper secondary insertion pipe means is supported by the lower insertion pipe means.

10. A support comprising:

a support pipe means defining an external thread and a pair of elongated holes at an upper end portion thereof, the elongated holes penetrating from a first outer peripheral surface of the support pipe means on one side thereof to a second outer peripheral surface of the support pipe means on another side thereof and extending in an axial direction of the support pipe means;

a support ring means having an internal thread formed therein, the internal thread of the support ring means being engageable with the external thread of the support pipe means such that the support ring means is movable in the axial direction;

an insertion pipe means having a lower end portion movably insertable into the support pipe means and defining plural pairs of pin holes at intervals in the axial direction of the insertion pipe means which penetrate from a first outer peripheral surface of the insertion pipe means on one side thereof to a second outer peripheral surface of the insertion pipe means on another side thereof;

a support pin removably insertable in each of the pairs of pin holes, the support pin having such a length that both ends thereof protrude beyond the pair of elongated holes when the support pin is inserted in one of the pairs of pin holes of the insertion pipe means through the pair of elongated holes formed in the support pipe means while the insertion pipe means is inserted in the support pipe means, wherein the insertion pipe means can be supported by the support pipe means in a manner such that a height of the insertion pipe means can be adjusted when both ends of the support pin are placed on an upper end surface of the support ring means, the support pin having an external thread portion formed at one end, and a plate portion formed at one end of the external thread portion, the plate portion having a width that is larger than an outer diameter of an opposite end of the support pin; and a rotary operation handle means fitted to the support ring means, the rotary operation handle means having at least one rotary operation handle with a first end thereof rotatably supported by an outer peripheral portion of the support ring means, the rotary operation handle including a round pipe member and an internal thread means formed in an inner peripheral portion at a second end the rotary operation handle opposite the first end, such that the support pin is insertable into the rotary operation handle from the second end in a manner that the external thread of the support pin is engaged with the internal thread means of the rotary operation handle so as to be removably held by the rotary operation handle.

11. A support according to claim 10, wherein the internal thread means of the rotary operation handle includes two engaging protrusions that inwardly protrude from the inner peripheral portion at the second end in a radial direction of the rotary operation handle so as to be opposed to each other.

* * * * *